US011554586B2

(12) United States Patent
Yokomaku et al.

(10) Patent No.: US 11,554,586 B2
(45) Date of Patent: Jan. 17, 2023

(54) LIQUID DISCHARGE DEVICE AND LIQUID DISCHARGE APPARATUS INCORPORATING SAME

(71) Applicants: Hiroomi Yokomaku, Kanagawa (JP); Tomomi Katoh, Kanagawa (JP)

(72) Inventors: Hiroomi Yokomaku, Kanagawa (JP); Tomomi Katoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 36 days.

(21) Appl. No.: 17/205,027

(22) Filed: Mar. 18, 2021

(65) Prior Publication Data

US 2021/0291533 A1 Sep. 23, 2021

(30) Foreign Application Priority Data

Mar. 23, 2020 (JP) ..... JP2020-051435

(51) Int. Cl.
*B41J 2/165* (2006.01)
*B41J 2/14* (2006.01)

(52) U.S. Cl.
CPC ..... *B41J 2/16535* (2013.01); *B41J 2/16523* (2013.01); *B41J 2/16552* (2013.01); *B41J 2/14201* (2013.01); *B41J 2002/16558* (2013.01)

(58) Field of Classification Search
CPC ..... B41J 2/16535; B41J 2/16523; B41J 2/16552; B41J 2/14201; B41J 2002/16558; B41J 2002/14387; B41J 2/1603; B41J 2002/1437; B41J 3/4073; B41J 3/40731; B41J 3/40733
See application file for complete search history.

(56) References Cited

U.S. PATENT DOCUMENTS 5,883,648 A * 3/1999 Hetzer ..... B41J 2/16585 347/29
2015/0009254 A1 1/2015 Kaiba et al.

FOREIGN PATENT DOCUMENTS

| | | |
|---|---|---|
| JP | 9-052372 | 2/1997 |
| JP | 2015-027636 | 2/2015 |
| JP | 2020-168786 | 10/2020 |

* cited by examiner

*Primary Examiner* — Geoffrey S Mruk
(74) *Attorney, Agent, or Firm* — Xsensus LLP

(57) ABSTRACT

A liquid discharge device includes a head including a discharge port. The head discharges a liquid from the discharge port toward an object. The liquid discharge device further includes a liquid receiving surface to receive the liquid discharged from the discharge port, a liquid collector to collect the liquid received by the liquid receiving surface, and a moving unit to hold the liquid receiving surface and the liquid collector. The moving unit is movable at a facing position where the liquid receiving surface faces the discharge port without changing an inclination of the liquid collector with respect to a horizontal plane.

15 Claims, 24 Drawing Sheets

LIQUID DISCHARGE DEVICE AND LIQUID DISCHARGE APPARATUS INCORPORATING SAME

CROSS-REFERENCE TO RELATED APPLICATION

This patent application is based on and claims priority pursuant to 35 U.S.C. § 119(a) to Japanese Patent Application No. 2020-051435, filed on Mar. 23, 2020, in the Japan Patent Office, the entire disclosure of which is hereby incorporated by reference herein.

BACKGROUND

Technical Field

Embodiments of the present disclosure relate to a liquid discharge device and a liquid discharge apparatus incorporating the liquid discharge device.

Description of the Related Art

There is known a liquid discharge apparatus such as an inkjet printer in which when a drive gear is rotated, a carriage retracting mechanism is retracted and a capping lever is rotated, so that a cleaner removes deposits such as ink and substances adhering to a surface of a nozzle of a print head, and a cap contacts the nozzle to prevent ink from drying.

There is also known a liquid discharge apparatus such as a printing apparatus that controls an inkjet nozzle in a head array. The inkjet nozzle discharges ink in the distance as a pressurized air is applied to an ink tank filled with the ink. The plurality of inkjet nozzles is arranged in the head array. The head array is reciprocally and linearly movable on a linear rail. A robot arm of a multi-articulated robot holds the linear rail. The printing apparatus controls the position of the robot arm based on position data and drives a predetermined inkjet nozzle in conjunction with the position data.

SUMMARY

Embodiments of the present disclosure describe an improved liquid discharge device that includes a head including a discharge port. The head discharges a liquid from the discharge port toward an object. The liquid discharge device further includes a liquid receiving surface to receive the liquid discharged from the discharge port, a liquid collector to collect the liquid received by the liquid receiving surface, and a moving unit to hold the liquid receiving surface and the liquid collector. The moving unit is movable at a facing position where the liquid receiving surface faces the discharge port without changing an inclination of the liquid collector with respect to a horizontal plane.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1B:
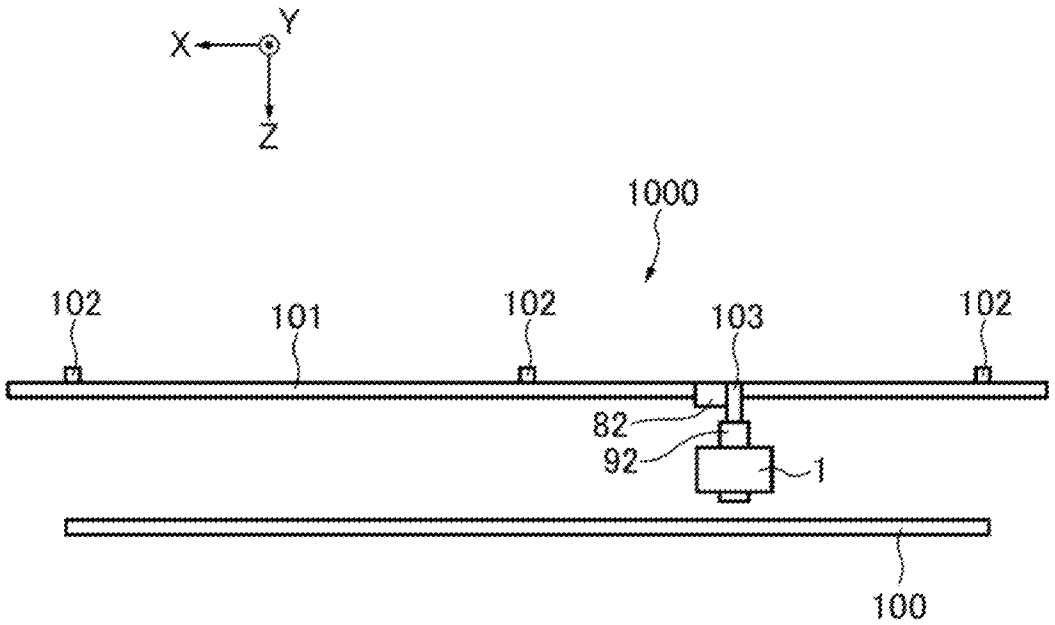
FIGS. 1A and 1B are schematic views of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity.

However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary or when the components are collectively referred to.

Figure 1A:
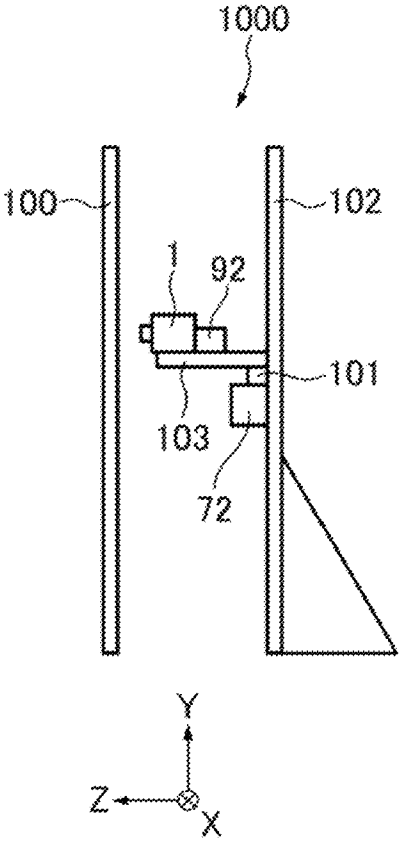

Embodiments of the present disclosure are described below with reference to the accompanying drawings. FIGS. 1A and 1B are schematic views of a liquid discharge apparatus 1000 according to an embodiment of the present disclosure. FIG. 1A is a right-side view, and FIG. 1B is a plan view of the liquid discharge apparatus 1000.

The liquid discharge apparatus 1000 includes a carriage 1 disposed facing an object 100. The carriage 1 discharges ink as an example of a liquid toward the object 100. The carriage 1 is an example of a liquid discharge device that discharges a liquid toward the object 100.

The liquid discharge apparatus 1000 includes a Z-axis rail 103, an X-axis rail 101, and a Y-axis rail 102. The Z-axis rail 103 movably holds the carriage 1 in a Z-axis direction. The X-axis rail 101 movably holds the Z-axis rail 103 in an X-axis direction. The Y-axis rail 102 movably holds the X-axis rail 101 in a Y-axis direction. The X-axis rail 101, the Y-axis rail 102, and the Z-axis rail 103 are examples of a guide that movably holds the carriage 1.

Further, the liquid discharge apparatus 1000 includes a Z-direction driver 92, an X-direction driver 72, and a Y-direction driver 82. The Z-direction driver 92 moves the carriage 1 in the Z-axis direction along the Z-axis rail 103. The X-direction driver 72 moves the Z-axis rail 103 in the X-axis direction along the X-axis rail 101. The Y-direction driver 82 moves the X-axis rail 101 in the Y-axis direction along the Y-axis rail 102.

Thus, the liquid discharge apparatus 1000 can discharge ink onto the object 100 while moving the carriage 1 in the X-axis direction, the Y-axis direction, and the Z-axis direction to draw images on the object 100. Although the object 100 illustrated in FIGS. 1A and 1B has a flat plate shape, the object 100 may have a curved surface as long as the surface is nearly vertical or the surface curves with the large radius of curvature, such as a body of a vehicle such as a car, a truck, or an aircraft.

Figure 2:
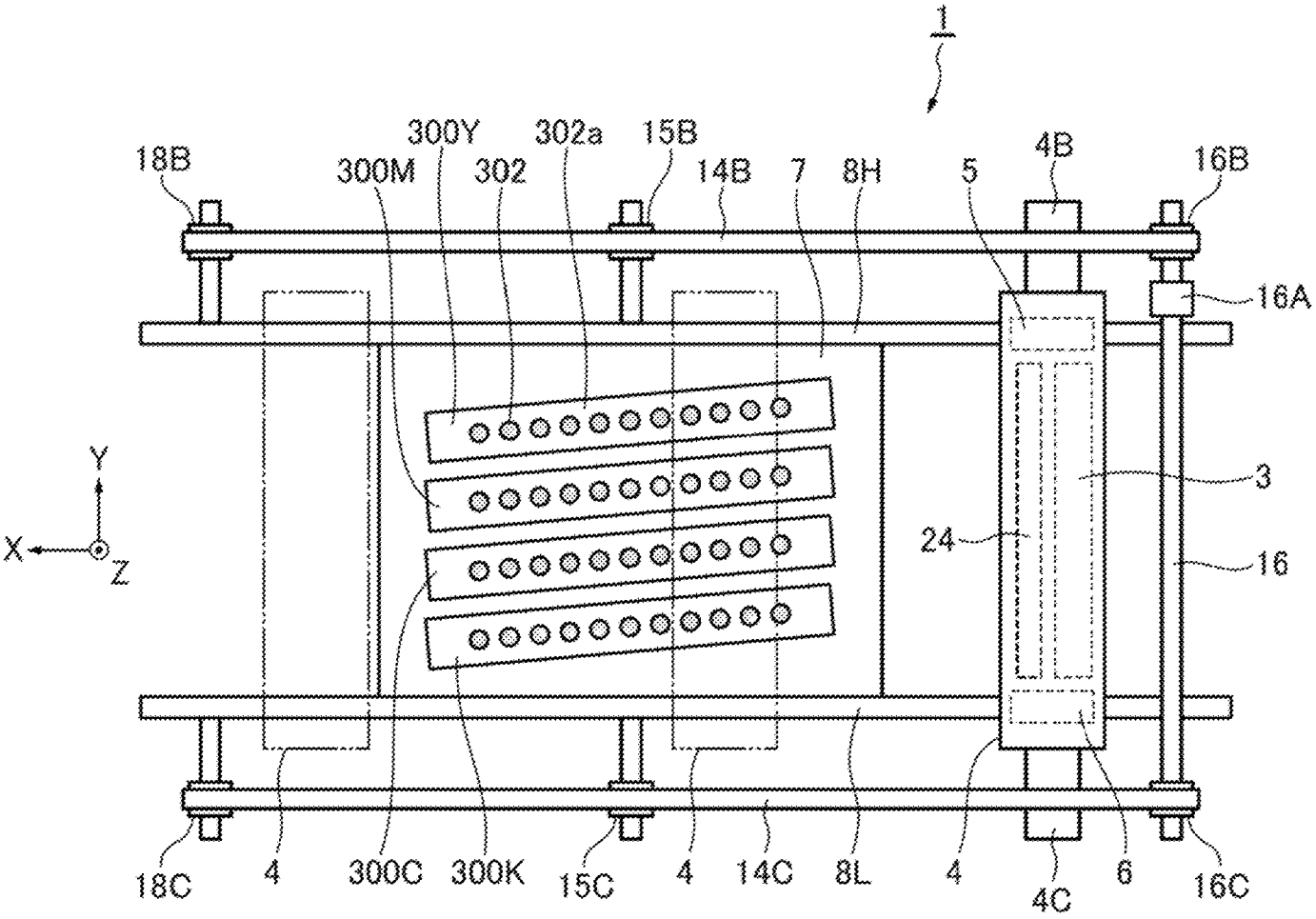
FIG. 2 is a front view of a carriage according to the present embodiment.
Figure 3:
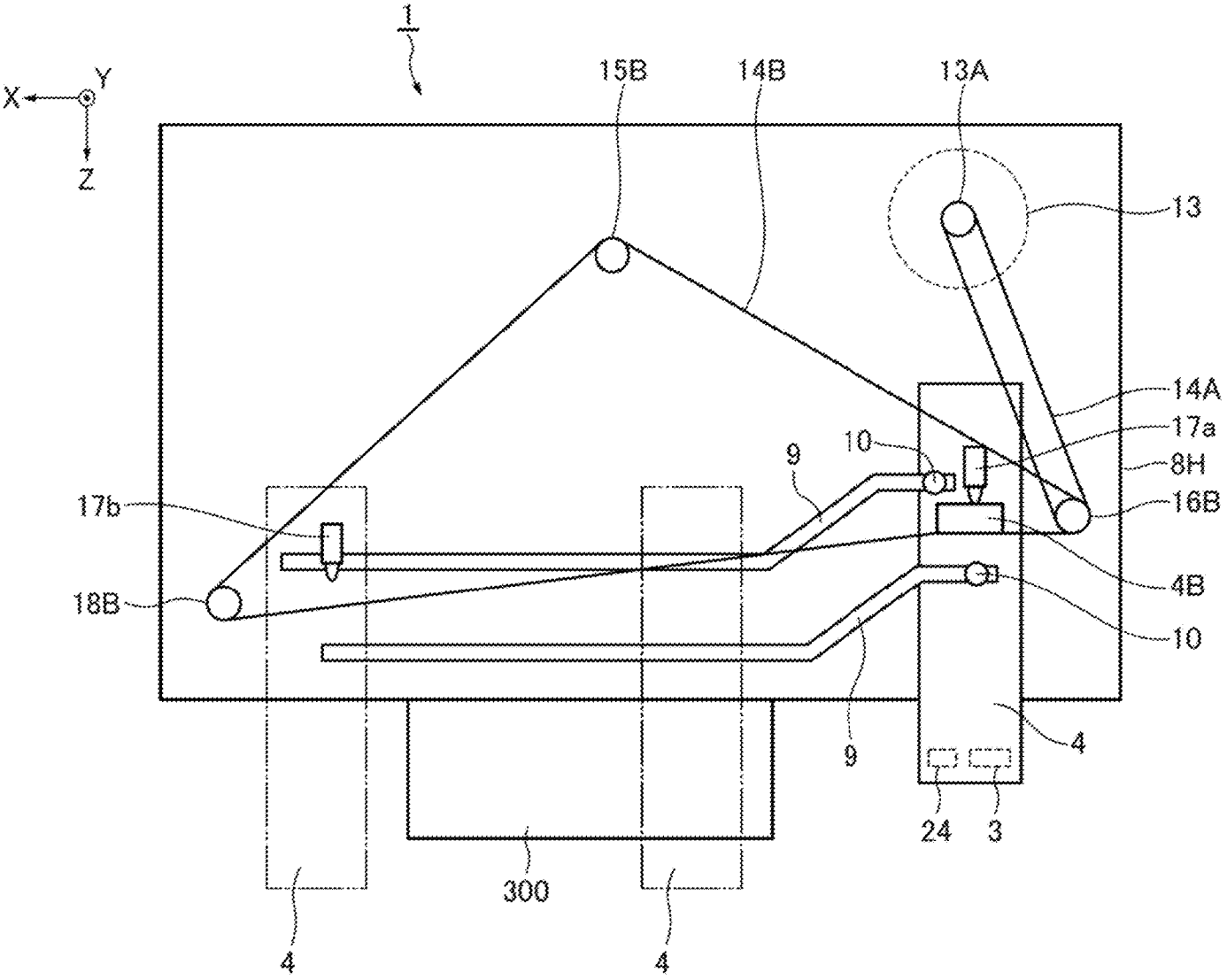
FIG. 3 is a plan view of the carriage according to the present embodiment.
Figure 4:
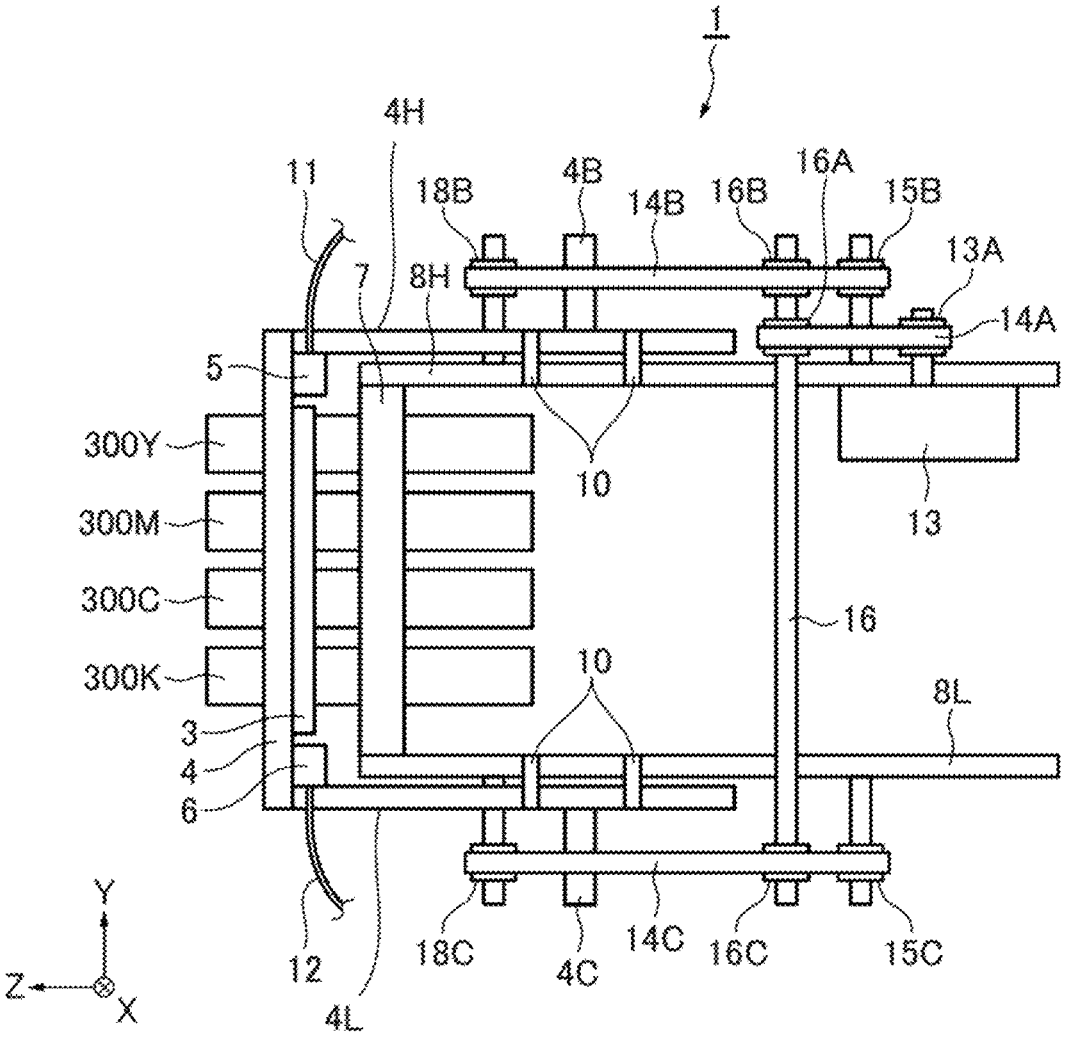
FIG. 4 is a side view of the carriage according to the present embodiment.

FIG. 2 is a front view of the carriage 1 according to the present embodiment. FIG. 3 is a plan view of the carriage 1 according to the present embodiment. FIG. 4 is a side view of the carriage 1 according to the present embodiment.

The carriage 1 includes heads 300Y, 300M, 300C, and 300K that discharge inks of respective colors of yellow (Y), magenta (M), cyan (C), and black (K). Hereinafter, the heads 300Y, 300M, 300C, and 300K are collectively referred to as the "heads 300." Each of the heads 300 includes a nozzle plate face 302*a* having a plurality of nozzles 302. The nozzle 302 is an example of a discharge port to discharge a liquid toward the object 100, and the nozzle plate face 302*a* is an example of a liquid discharge surface.

The carriage 1 includes a head fixing plate 7 to secure the heads 300Y, 300M, 300C, and 300K such that the nozzle plate face 302*a* intersects with a horizontal plane, and the plurality of nozzles 302 are arrayed in the direction inclined with respect to the X-axis direction (see FIG. 2). Thus, the nozzle 302 discharges ink in the direction intersecting with the direction of gravity. Specifically, the heads 300Y, 300M, 300C, and 300K are arranged so that the nozzle plate face 302*a* is perpendicular to the horizontal plane. Thus, the heads 300Y, 300M, 300C, and 300K discharge ink from the nozzles 302 in the horizontal direction.

The carriage 1 further includes a wiper unit 4 including an ink receiving surface 24, a wiper 3, a cleaning liquid supplier 5, and a cleaning liquid collector 6. The ink receiving surface 24 is an example of a liquid receiving surface that receives the ink discharged from the nozzle 302. The wiper 3 is an example of a contact part that contacts the nozzle 302 and the nozzle plate face 302*a* when the wiper unit 4 moves while the ink receiving surface 24 facing the nozzle 302 (nozzle plate face 302*a*). The wiper 3 extends in a direction parallel to the nozzle plate face 302*a*. The wiper 3 is also an example of a protrusion that protrudes toward the nozzle 302 from the ink receiving surface 24 and extends in the direction parallel to the ink receiving surface 24 in a state in which the ink receiving surface 24 faces the nozzle 302 (nozzle plate face 302*a*).

A cleaning liquid is supplied to the cleaning liquid supplier 5 via a cleaning-liquid supply tube 11 as a flexible tube (see FIG. 4). The cleaning liquid supplier 5 supplies the cleaning liquid to the wiper 3 and the ink receiving surface 24 from above (see FIG. 4). The cleaning liquid collector 6 is an example of a liquid collector to collect the ink received by the ink receiving surface 24. The cleaning liquid collector 6 is disposed below the ink receiving surface 24. In other words, the cleaning liquid collector 6 is an example of a liquid holder to hold the ink received by the ink receiving surface 24. The cleaning liquid collector 6 is also an example of a cleaning liquid collector to collect the cleaning liquid supplied to the wiper 3 and the ink receiving surface 24. In other words, the cleaning liquid collector 6 is also an example of a cleaning liquid holder to hold the cleaning liquid supplied to the wiper 3 and the ink receiving surface 24. The cleaning liquid collector 6 drains the ink and the cleaning liquid via a cleaning-liquid collection tube 12 as a flexible tube.

The carriage 1 includes an upper guide plate 8H, a lower guide plate 8L, an upper plate 4H, and a lower plate 4L. The upper guide plate 8H is secured to an upper part of the head fixing plate 7. The lower guide plate 8L is secured to a lower part of the head fixing plate 7. The upper plate 4H is secured to an upper part of the wiper unit 4. The lower plate 4L is secured to a lower part of the wiper unit 4. The head fixing plate 7, the upper guide plate 8H, and the lower guide plate 8L are examples of chassis that hold the nozzles 302 of the heads 300 and movably supports the wiper unit 4. A guide groove 9 is formed in the upper guide plate 8H, and the guide groove 9 is also formed in the lower guide plate 8L. The upper plate 4H and the lower plate 4L include pins 10 protruding toward the upper guide plate 8H and the lower guide plate 8L, respectively.

Further, the carriage 1 includes a motor 13, a roller 13A, a belt 14A, a roller 16A, a rotation shaft 16, a roller 16B, a belt 14B, a roller 15B, a roller 18B, and an upper mount 4B. The roller 13A rotates coaxially with the motor 13. The belt 14A is wound around the roller 13A and the roller 16A. The rotation shaft 16 coaxially supports the roller 16A and the roller 16B. The belt 14B is wound around the rollers 15B, 16B, and 18B. The upper mount 4B couples the upper plate 4H of the wiper unit 4 and the belt 14B. The carriage 1 also includes a roller 16C, a belt 14C, a roller 15C, a roller 18C, and a lower mount 4C. The rotation shaft 16 also coaxially supports the roller 16C. The belt 14C is wound around the rollers 15C, 16C, and 18C. The lower mount 4C couples the lower plate 4L of the wiper unit 4 and the belt 14C.

The carriage 1 further includes sensors 17*a* and 17*b*. The sensor 17*a* detects that the upper mount 4B positions at a right end (negative side in the X-axis direction). The sensor 17*b* detects that the lower mount 4C positions at a left end (positive side in the X-axis direction). In the present embodiment, the sensor 17*a* detects that the wiper unit 4 positions at a standby position (home position), and the sensor 17*b* detects that the wiper unit 4 positions at a moving end position (return position).

The carriage 1 with the above-described configuration drives the motor 13 and transmits a rotational driving force of the motor 13 to the belts 14B and 14C via the belt 14A to move the wiper unit 4 coupled to the belts 14B and 14C. At this time, the pins 10 slide inside the guide grooves 9 to move along the guide grooves 9. Thus, the wiper unit 4 moves with a trajectory along a shape of the guide grooves 9.

As illustrated in FIG. 2, when the wiper unit 4 moves in the left and right direction (X-axis direction), the wiper unit 4 moves in the horizontal direction (so as not to change a position in the Y-axis direction) so that a posture of the wiper unit 4 does not change. Thus, the wiper unit 4 moves in the left and right direction (X-axis direction) without changing an inclination of the wiper unit 4 with respect to the horizontal plane and without changing a height of the wiper unit 4. Here, a position of the cleaning liquid collector 6 with respect to the wiper unit 4 is fixed. Thus, an inclination of the cleaning liquid collector 6 with respect to the horizontal plane does not change during the movement of the wiper unit 4 in the left and right direction (X-axis direction). Further, a height of the cleaning liquid collector 6 does not change during the movement of the wiper unit 4 in the left and right direction (X-axis direction).

As illustrated in FIG. 3, the guide grooves 9 are formed so that the wiper unit 4 moves from a back side to a front side (positive side in the Z-axis direction) as the wiper unit 4 moves from the right side to the left side (positive side in the X-axis direction). At the standby position (right side in FIG. 3), the wiper unit 4 is located closer to the back side (negative side in the Z-axis direction) than the nozzles 302 and does not face the nozzles 302.

Then, as the wiper unit 4 moves to the left side (positive side in the X-axis direction), the wiper unit 4 moves to the front side of the nozzles 302 (positive side in the Z-axis direction) and further moves to the left side (positive side in the X-axis direction) to face the nozzles 302 (facing position). In a state in which the wiper unit 4 faces the nozzles 302, the wiper 3 can contact the nozzle plate face 302*a*, and the ink receiving surface 24 can receive the ink discharged from the nozzles 302. The ink may be dried in the nozzles 302.

The wiper unit 4 moves to the left side (positive side in the X-axis direction) while the wiper unit 4 facing the nozzles 302, so that the wiper 3 wipes and cleans the nozzle plate face 302*a* and the nozzles 302 of the heads 300. When the wiper unit 4 further moves to the left (positive side in the X-axis direction), the wiper unit 4 does not face the nozzles 302. Then, when the wiper unit 4 moves to the moving end position, the wiper unit 4 moves rightward (negative side in the X-axis direction) and returns to the standby position.

That is, the wiper unit 4 is an example of a moving unit that is movable between the facing position where the wiper 3 and the ink receiving surface 24 face the nozzle 302 (nozzle plate face 302*a*) and a position where the wiper 3 and the ink receiving surface 24 do not face the nozzle 302 (nozzle plate face 302*a*). Further, the wiper unit 4 is movable so that the wiper 3 is movable in the horizontal direction at the facing position where the wiper 3 faces the nozzle plate face 302*a*.

As described above, the carriage 1 includes the head 300 that discharges ink toward the object 100 from the nozzle 302, the ink receiving surface 24 that receives the ink discharged from the nozzle 302, the cleaning liquid collector 6 that holds (collects) the ink received by the ink receiving surface 24, and the wiper unit 4 that holds the ink receiving surface 24 and the cleaning liquid collector 6. The wiper unit 4 is movable at the facing position where the ink receiving surface 24 faces the nozzle 302 while keeping (maintain) the inclination of the cleaning liquid collector 6 with respect to the horizontal plane to be constant. In other words, the wiper unit 4 does not change the inclination of the cleaning liquid collector 6 with respect to the horizontal plane while the wiper unit 4 moves at the facing position where the ink receiving surface 24 faces the nozzle 302. That is, the wiper unit 4 is movable at the facing position where the ink receiving surface 24 faces the nozzle 302 without changing the inclination of the cleaning liquid collector 6 with respect to the horizontal plane.

Thus, the carriage 1 moves the ink receiving surface 24 to the facing position where the ink receiving surface 24 faces the nozzle 302 so that the heads 300 on the carriage 1 can discharge ink to the ink receiving surface 24 from the nozzle 302 without moving the nozzle 302 of the head 300 with respect to the ink receiving surface 24. Further, it is possible to reduce a possibility in which the ink received by the ink receiving surface 24 is shaken and overflown from the cleaning liquid collector 6 when the ink receiving surface 24 moves with respect to the nozzle 302.

The liquid discharge apparatus 1000 includes the carriage 1, the X-axis rail 101, the Y-axis rail 102, and the Z-axis rail 103 that movably hold the carriage 1 as illustrated in FIGS. 1A and 1B. Thus, the carriage 1 can discharge ink toward the object 100 while moving in the X-axis, Y-axis, and Z-axis directions. Irrespective of the position of the carriage 1 in the liquid discharge apparatus 1000, the carriage 1 moves the ink receiving surface 24 to the facing position where the ink receiving surface 24 faces the nozzle 302 when necessary to enable the head 300 to discharge ink to the ink receiving surface 24 from the nozzle 302 without moving the nozzle 302 of the head 300 toward the ink receiving surface 24, that is, without moving the carriage 1.

Thus, the liquid discharge apparatus 1000 can continuously draw high quality images with smaller downtime since the liquid discharge apparatus 1000 can reduce a time required for the carriage 1 to move to the ink receiving surface 24 as compared with the configuration in which the carriage 1 moves toward the ink receiving surface 24 whose position is fixed.

The wiper unit 4 is movable at the facing position where the ink receiving surface 24 faces the nozzle 302 without changing the height of the cleaning liquid collector 6. In addition, the wiper unit 4 is movable in the horizontal direction at the facing position where the ink receiving surface 24 faces the nozzle 302. Thus, when the wiper unit 4 moves, the ink held by the cleaning liquid collector 6 do not receive a force in the height direction (direction of gravity). Thus, the ink held by the cleaning liquid collector 6 is less likely to be shaken and overflown from the cleaning liquid collector 6.

The wiper unit 4 is movable between the facing position where the ink receiving surface 24 faces the nozzle 302 and the position where the ink receiving surface 24 does not face the nozzle 302 in the horizontal direction or without changing the inclination of the cleaning liquid collector 6 with respect to the horizontal plane. Thus, the carriage 1 moves the ink receiving surface 24 to the facing position where the ink receiving surface 24 faces the nozzle 302 so that the head 300 on the carriage 1 can discharge ink to the ink receiving surface 24 from the nozzles 302 without moving the nozzle 302 of the head 300 with respect to the ink receiving surface 24. Further, it is possible to reduce a possibility in which the ink received by the ink receiving surface 24 is shaken and overflown from the cleaning liquid collector 6 when the ink receiving surface 24 moves to the position where the ink receiving surface 24 does not face the nozzle 302.

The head 300 discharges ink from the nozzle 302 in the direction intersecting with the direction of gravity, and the cleaning liquid collector 6 is disposed below the ink receiving surface 24. Thus, the cleaning liquid collector 6 can hold the ink that is discharged toward the ink receiving surface 24 from the nozzle 302 of the head 300 and dropped to the cleaning liquid collector 6 under gravity. The cleaning liquid collector 6 holds the cleaning liquid supplied to the ink receiving surface 24. Thus, the wiper unit 4 can clean the ink receiving surface 24 and also prevent the cleaning liquid received by the ink receiving surface 24 from being overflown from the cleaning liquid collector 6 when the ink receiving surface 24 moves to the position where the ink receiving surface 24 does not face the nozzle 302. The wiper unit 4 includes the cleaning liquid supplier 5 that supplies the cleaning liquid to the ink receiving surface 24. Thus, the wiper unit 4 can reliably supply the cleaning liquid to the ink receiving surface 24 to reliably clean the ink receiving surface 24.

The carriage 1 includes the nozzle plate face 302*a* including nozzles 302 to discharge ink toward the object 100, the wiper 3 extending in the direction parallel to the nozzle plate face 302*a* to contact the nozzle plate face 302*a*, the cleaning liquid collector 6 to hold (collect) the cleaning liquid supplied to the wiper 3, and the wiper unit 4 that holds the wiper 3 and the cleaning liquid collector 6. The wiper unit 4 is movable between the facing position where the wiper 3 faces the nozzle plate face 302*a* and the position where the wiper 3 does not face the nozzle plate face 302*a* without changing the inclination of the cleaning liquid collector 6 with respect to the horizontal plane.

The wiper 3 moves to the facing position where the wiper 3 faces the nozzle plate face 302*a* so that the wiper 3 supplied with the cleaning liquid can contact the nozzle plate face 302*a* to wipe and clean the nozzle plate face 302*a* without moving the nozzle plate face 302*a* of the head 300 toward the wiper 3. Further, the carriage 1 can reduce a possibility in which the cleaning liquid in the cleaning liquid collector 6 is shaken and overflown from the cleaning liquid collector 6 when the wiper 3 moves to the position where the wiper 3 does not face the nozzle plate face 302*a*.

The liquid discharge apparatus 1000 includes the carriage 1, the X-axis rail 101, the Y-axis rail 102, and the Z-axis rail 103 that movably hold the carriage 1 as illustrated in FIGS. 1A and 1B. Thus, the carriage 1 can discharge ink toward the object 100 while moving in the X-axis, Y-axis, and Z-axis directions. In addition, irrespective of the position of the carriage 1 in the liquid discharge apparatus 1000, the carriage 1 moves the wiper 3 to the facing position where the wiper 3 faces the nozzle plate face 302*a* when necessary, so that the wiper 3 supplied with the cleaning liquid comes into contact with the nozzle plate face 302*a* to wipe and clean the nozzle plate face 302*a* without moving the nozzle plate face 302*a* toward the wiper 3, that is, without moving the carriage 1.

Thus, the liquid discharge apparatus 1000 can continuously draw high quality images with smaller downtime since the liquid discharge apparatus 1000 can reduce a time required for the carriage 1 to move to the wiper 3 as compared with the configuration in which the carriage 1 moves toward the wiper 3 whose position is fixed.

The wiper unit 4 is movable without changing the height of the cleaning liquid collector 6. Thus, when the wiper unit 4 moves, the cleaning liquid held by the cleaning liquid collector 6 does not receive a force in the height direction (direction of gravity). Thus, the cleaning liquid held by the cleaning liquid collector 6 is less likely to be shaken and overflown from the cleaning liquid collector 6.

The carriage 1 includes the head fixing plate 7 and the upper and lower guide plates 8H and 8L that hold the nozzle plate face 302*a* of the head 300 and movably supports the wiper unit 4, as the examples of chassis. The wiper unit 4 includes the cleaning liquid supplier 5 that supplies the cleaning liquid to the wiper 3. Thus, the cleaning liquid supplier 5 reliably supplies the cleaning liquid to the wiper 3 so that the wiper 3 can reliably wipe and clean the nozzle plate face 302*a*.

The nozzle plate face 302*a* is arranged in the direction intersecting with the horizontal plane, the wiper 3 extends downward, and the cleaning liquid supplier 5 supplies the cleaning liquid from above the wiper 3. Thus, the cleaning liquid supplier 5 reliably supplies the cleaning liquid to a lower part of the wiper 3 under gravity so that the wiper 3 can reliably wipe and clean a lower part of the nozzle plate face 302*a*.

Figure 5:
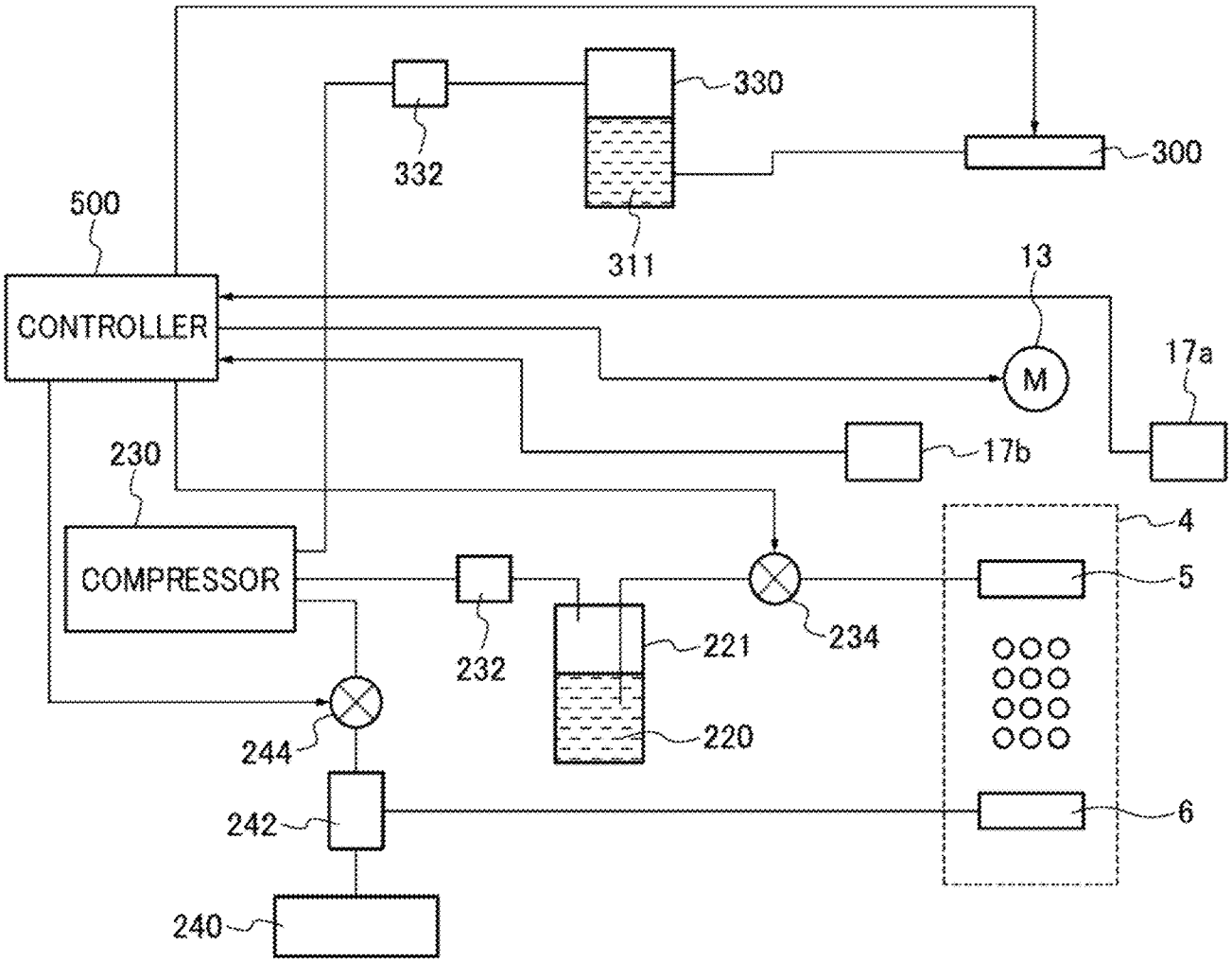
FIG. 5 is a schematic diagram of a control system according to the present embodiment.

FIG. 5 is a schematic diagram of a control system according to the present embodiment. The liquid discharge apparatus 1000 includes a compressor 230 and air regulator 332 to supply pressurized air and an ink tank 330 to store ink 311. Thus, the liquid discharge apparatus 1000 can supply the pressurized air from the compressor 230 and the air regulator 332 to the ink tank 330. Here, the compressor 230 is an example of a pressurized air supplier, and the ink tank 330 is an example of a liquid holder. Further, the liquid discharge apparatus 1000 includes an air regulator 232 connected to the compressor 230, a cleaning liquid tank 221 to store a cleaning liquid 220, and a valve 234 between the cleaning liquid tank 221 and the cleaning liquid supplier 5. Thus, the liquid discharge apparatus 1000 can supply the pressurized air from the compressor 230 and the air regulator 232 to the cleaning liquid tank 221.

Further, the liquid discharge apparatus 1000 includes a vacuum generator 242, a solenoid valve 244, and a waste liquid tank 240. The solenoid valve 244 is connected to the compressor 230 and a pressure port of the vacuum generator 242. The waste liquid tank 240 is connected to a drain port of the vacuum generator 242. The cleaning-liquid collection tube 12 is connected to a suction port of the vacuum generator 242. The vacuum generator 242 is an example of a negative pressure generator, and the waste liquid tank 240 is an example of a cleaning liquid collection unit.

The liquid discharge apparatus 1000 further includes a controller 500 that controls the motor 13 based on detection signals from the sensors 17*a* and 17*b* as illustrated in FIGS. 2 to 4. Further, the controller 500 controls the X-direction driver 72, the Y-direction driver 82, and the Z-direction driver 92 illustrated in FIGS. 1A and 1B to move the carriage 1 in the X-axis, Y-axis, and Z-axis directions, and further controls the heads 300, the valve 234, and the solenoid valve 244.

The controller 500 includes circuitry including, for example, a central processing unit (CPU), a read-only memory (ROM), a random access memory (RAM), and an interface (I/F). The CPU controls the entire liquid discharge apparatus 1000. The ROM stores programs, which include a program to cause the CPU to perform the control of a drawing operation, for example, and other fixed data. The RAM temporarily stores drawing data and the like. The I/F transmits data and signals that are used when the controller 500 receives drawing data and the like from a host such as a personal computer (PC).

In the above-described configuration, the controller 500 controls the head 300, so that the pressurized ink 311 is supplied from the ink tank 330 to the head 300. When the controller 500 opens the valve 234, the pressurized cleaning liquid 220 is supplied from the cleaning liquid tank 221 to the cleaning liquid supplier 5. When the controller 500 opens the solenoid valve 244 and the compressor 230 sends the pressurized air to the vacuum generator 242, a negative pressure is generated in the suction port of the vacuum generator 242. The liquid in the cleaning liquid collector 6 is sucked through the cleaning-liquid collection tube 12 and drained to the waste liquid tank 240.

As described above, the liquid discharge apparatus 1000 includes the waste liquid tank 240 connected to the cleaning liquid collector 6 via the cleaning-liquid collection tube 12. Thus, the cleaning liquid held by the cleaning liquid collector 6 can be collected by the waste liquid tank 240 irrespective of the position of the carriage 1 with respect to the object 100. The liquid discharge apparatus 1000 includes the vacuum generator 242 that generates a negative pressure between the cleaning-liquid collection tube 12 and the waste liquid tank 240. Thus, the cleaning liquid held by the cleaning liquid collector 6 can be more reliably collected by the waste liquid tank 240.

The liquid discharge apparatus 1000 includes the compressor 230 that supplies the pressurized air, and an ink tank 330 that receives the pressurized air supplied from the compressor 230 and supplies pressurized ink 311 to the nozzle 302 of the head 300. The vacuum generator 242 generates a negative pressure using the pressurized air received from the compressor 230. Thus, the cleaning liquid held by the cleaning liquid collector 6 can be more reliably collected by the waste liquid tank 240 using the compressor 230 for supplying ink to the heads 300.

Figure 6:
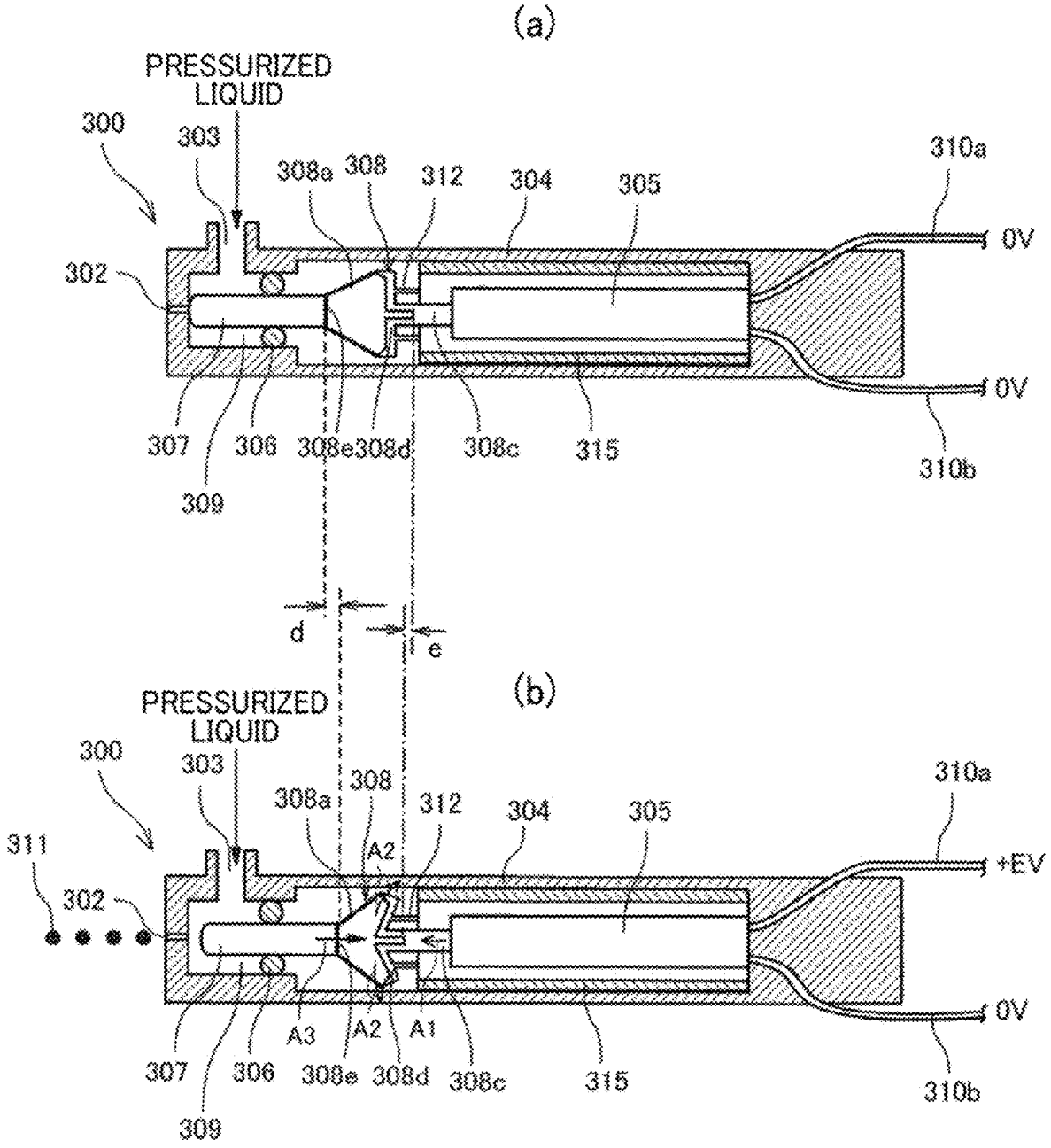
FIG. 6 is a schematic cross-sectional view of one nozzle part of a head according to the present embodiment.

FIG. 6 is a schematic cross-sectional view of one nozzle part as an example of the head 300 according to the present embodiment. A part (a) of FIG. 6 illustrates a state in which the nozzle 302 is closed, and a part (b) of FIG. 6 illustrates a state in which the nozzle 302 is opened.

The head 300 includes a hollow housing 304 including the nozzle 302 at a distal end of the head 300 to discharge a liquid. The housing 304 includes an injection port 303 near the nozzle 302, and the liquid is injected inside the housing 304 from the injection port 303. The head 300 includes a piezoelectric element 305, a valve 307, and a valve mover 308 accommodated in the housing 304.

The piezoelectric element 305 expands and contracts in response to an externally applied voltage. The valve 307 opens and closes the nozzle 302. The valve mover 308 is disposed between the valve 307 and the piezoelectric element 305. The valve mover 308 moves the valve 307 toward or away from the nozzle 302. The piezoelectric element 305 is housed in a case 315, and a pair of wirings 310*a* and 310*b* to apply a voltage to the piezoelectric element 305 are connected to the piezoelectric element 305 and are drawn outside the housing 304. The piezoelectric element 305 drives the valve 307 via the valve mover 308.

A sealing 306 is disposed between the valve 307 and the housing 304 to prevent the pressurized liquid injected from the injection port 303 from entering the piezoelectric element 305 side of the housing 304. Thus, a liquid chamber 309 into which the pressurized liquid is injected from the injection port 303 is formed. That is, the liquid chamber 309 is accommodated in the housing 304. The valve 307 is an example of an opening and closing member that opens and closes a flow path between the liquid chamber 309 and the nozzle 302.

The housing 304 has a cylindrical body such as a cylinder or a square tube and has an enclosed space that is closed except for the nozzle 302 and the injection port 303. The nozzle 302 is an opening formed at the distal end of the housing 304, and the ink 311 is discharged from the nozzle 302. The injection port 303 is formed on a side surface of the housing 304 near the nozzle 302. The pressurized liquid is continuously supplied to the injection port 303.

The piezoelectric element 305 is formed using zirconia ceramics or the like. A drive waveform (drive voltage) is applied to the piezoelectric element 305 via the wirings 310*a* and 310*b*. The sealing 306 is, for example, a packing, an O-ring, or the like. The sealing 306 externally fitted on the valve 307 can prevent the liquid from flowing into the piezoelectric element 305 side from the injection port 303 side of the housing 304.

The valve mover 308 includes a deformable part 308*a* having a substantially trapezoidal cross-section formed of a resiliently deformable elastic member, such as rubber, soft resin, a thin metal plate, or the like. A coupling portion 308*e* corresponding to a top side of the substantially trapezoidal cross-section of the deformable part 308*a* is secured to a base end surface of the valve 307. A long side corresponding to a bottom of the substantially trapezoidal cross-section of the deformable part 308*a* is coupled to a bent side 308*d*. A center portion of the bent side 308*d* in the radial direction is coupled to a guide part 308*c*, and a part between the center portion and an end portion in the radial direction of the bent side 308*d* is coupled to a fixed part 312. One end of the fixed part 312 is coupled to the case 315.

When a predetermined voltage is applied to the piezoelectric element 305, the piezoelectric element 305 expands to move the valve mover 308 so that the guide part 308*c* moves toward the nozzle 302 by a distance "e", for example, as illustrated in the part (b) of FIG. 6. Thus, a vicinity of the center portion of the bent side 308*d* is pushed into the valve mover 308 as indicated by arrow A1 in the part (b) of FIG. 6.

Then, the bent side 308*d* is displaced in the direction indicated by arrows A2 in the part (b) of FIG. 6 from a coupling portion between the guide part 308*c* and the fixed part 312 as a starting point of displacement since an outer peripheral side of the guide part 308*c* is coupled to the fixed part 312. When the bent side 308*d* is displaced in the direction indicated by arrows A2 in the part (b) of FIG. 6, the deformable part 308*a* is deformed so that a coupling portion 308*e* with the valve 307 is pulled in the direction indicated by arrow A3 in the part (b) of FIG. 6. As the deformable part 308*a* of the valve mover 308 is deformed, the valve 307 secured to the coupling portion 308*e* of the deformable part 308*a* is retracted by a distance "d", thereby opening the nozzle 302. That is, the guide part 308*c* moves toward the nozzle 302 by the distance "e" due to an expansion of the piezoelectric element 305, so that the valve 307 moves by the distance "d" in the direction (rightward) opposite a moving direction (leftward or the direction of expansion of the piezoelectric element 305) of the guide part 308*c*.

Here, a distance between the coupling portion 308*e* and the bent side 308*d* or a length of the bent side 308*d* is adjusted to increase a moving amount of the valve 307 to be longer than a displacement amount of the piezoelectric element 305. The valve 307 is secured to the deformable part 308*a* of the valve mover 308 at the coupling portion 308*e* as described above. That is, the valve mover 308 can amplify the displacement of the piezoelectric element 305 and reduce the displacement of the piezoelectric element 305, so that the size of the piezoelectric element 305 can be downsized.

Figure 7A:
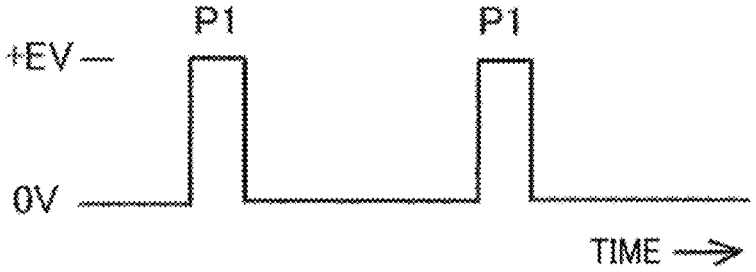
FIGS. 7A to 7C are waveform graphs of an example of a drive voltage for explaining the operation of the head.
Figure 7B:
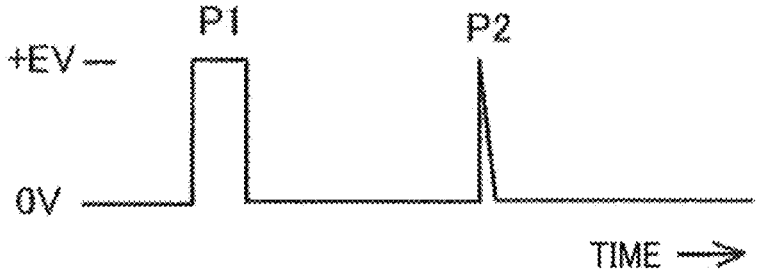
Figure 7C:
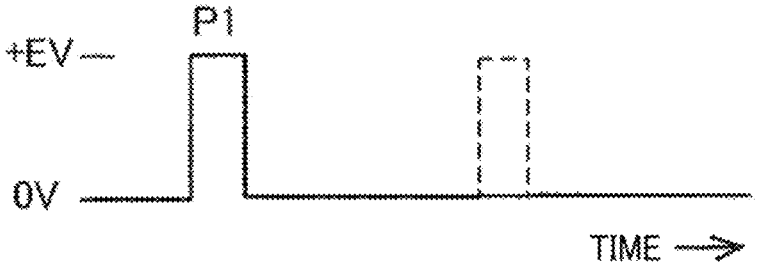

FIGS. 7A to 7C are waveform graphs of an example of a drive voltage for explaining the operation of the head 300. In the head 300, when no voltage is applied to the piezoelectric element 305, the piezoelectric element 305 is in a contracted state, so that no force is applied to the valve mover 308 by the piezoelectric element 305. At this time, the deformable part 308*a* of the valve mover 308 is in an expanded state (normal state) as illustrated in the part (a) of FIG. 6, and the valve 307 is pushed toward the nozzle 302 by an elastic force of the deformable part 308*a*. Therefore, the nozzle 302 is closed by the end surface of the valve 307, and the ink 311 is not discharged from the nozzle 302.

Here, as illustrated in FIG. 7A, when a voltage (+EV) having a waveform P1 is applied to the piezoelectric element 305, the piezoelectric element 305 expands. Thus, the deformable part 308*a* of the valve mover 308 deforms to pull the valve 307 in the direction indicated by the arrow A3 as illustrated in the part (b) of FIG. 6 as described above. Thus, the valve 307 opens the nozzle 302, and the pressurized liquid (ink 311) injected from the injection port 303 is discharged from the nozzle 302.

A voltage (+EV) having a waveform P2 may be applied to the piezoelectric element 305 as illustrated in FIG. 7B. A latter part of the waveform P2 disappear on the way as illustrated in FIG. 7B. Further, a voltage having a waveform to be applied to the piezoelectric element 305 may not be applied to the piezoelectric element 305 due to a power failure or the like as illustrated in FIG. 7C. At that time, the piezoelectric element 305 maintains the contracted state. Thus, the deformable part 308*a* of the valve mover 308 returns to the normal state as illustrated in the part (a) of FIG. 6. Therefore, the ink 311 is not discharged from the nozzle 302 since the valve 307 keeps the nozzle 302 closed. Thus, even in the case of a power failure or the like, the ink 311 can be prevented from accidentally leaking from the nozzle 302 or causing nozzle clogging.

Figure 8:
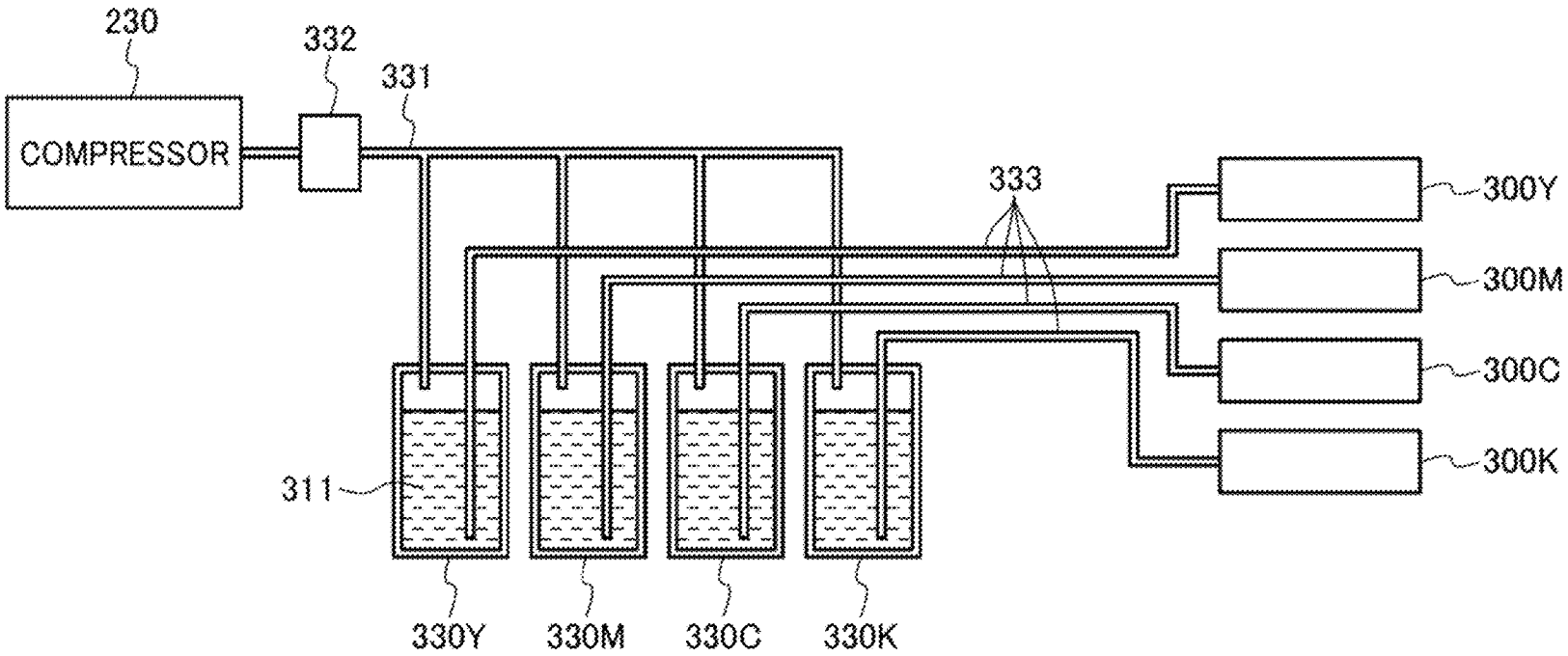
FIG. 8 is a schematic diagram of a liquid supply system for the head according to the present embodiment.

FIG. 8 is a schematic diagram of a liquid supply system for the head 300 according to the present embodiment. The liquid supply system to supply a liquid to the heads 300 is described with reference to FIG. 8. FIG. 8 illustrates the liquid supply system. The liquid discharge apparatus 1000 includes the ink tanks 330 (330Y, 330M, 330C, and 330K) as sealed containers that respectively stores inks 311 of respective colors to be discharged from the respective heads 300 (300Y, 300M, 300C, and 300K). Hereinafter, the ink tanks 330Y, 330M, 330C, and 330K are collectively referred to as the ink tanks 330. The ink tanks 330 and the injection ports 303 of the heads 300 are connected via tubes 333, respectively.

Further, the ink tanks 330 are connected to the compressor 230 via a pipe 331 including the air regulator 332 so that the pressurized air is supplied to the ink tanks 330 from the compressor 230. Accordingly, the pressurized inks 311 of respective colors are supplied to the injection ports 303 of heads 300, respectively. Thus, as described above, the ink 311 is discharged from the nozzle 302 of the head 300 in accordance with an opening and closing of the valve 307.

Figure 9:
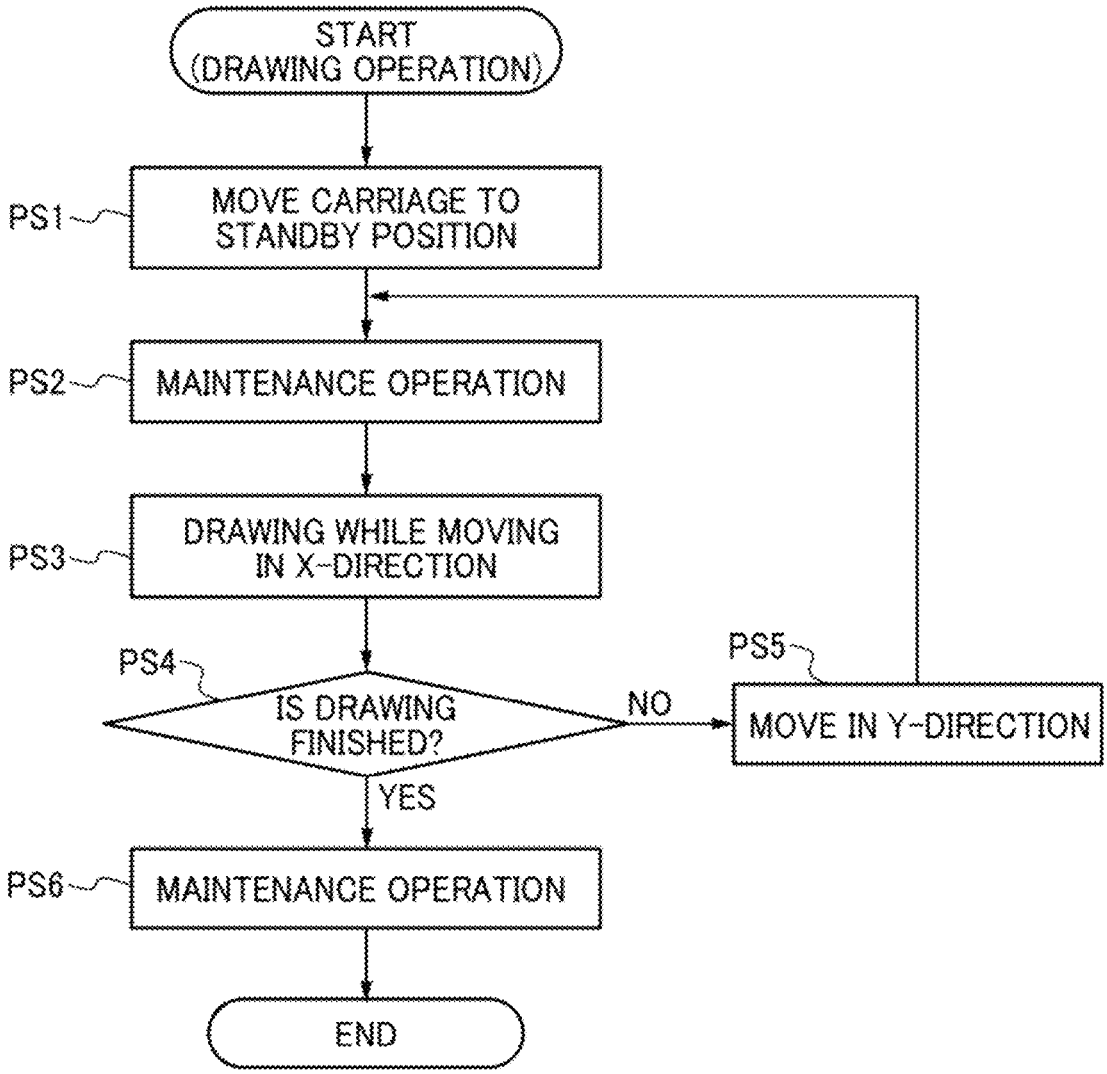
FIG. 9 is a flowchart illustrating a control of a drawing operation according to the present embodiment.
Figure 10A:
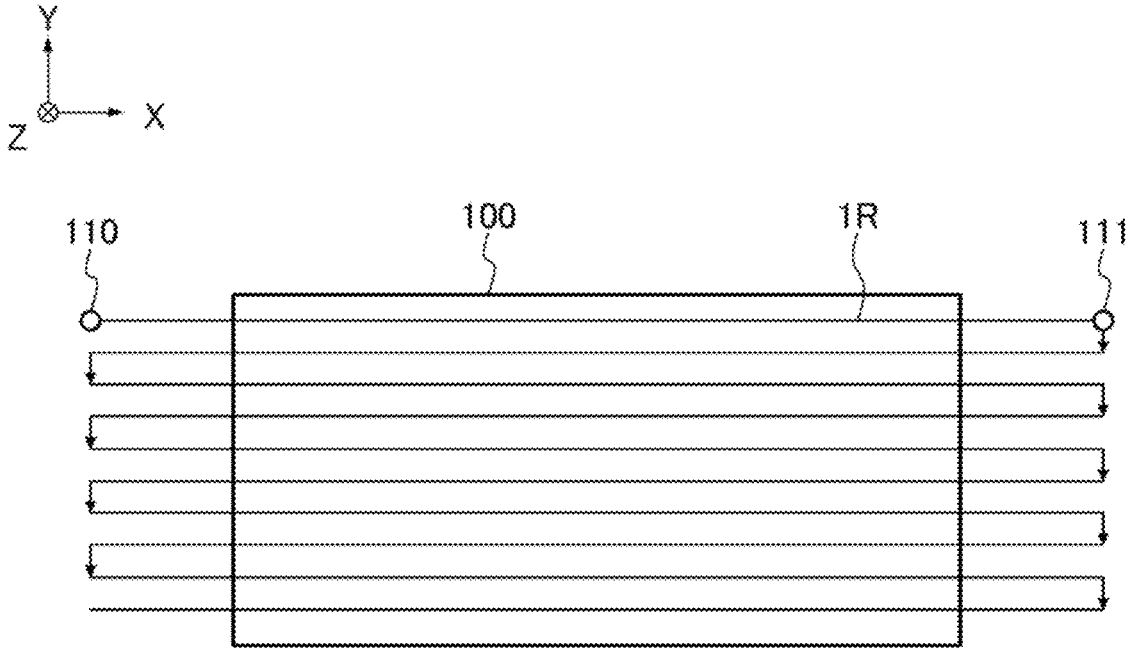
FIGS. 10A and 10B are schematic diagrams illustrating a movement trajectory of the carriage according to the present embodiment.
Figure 10B:
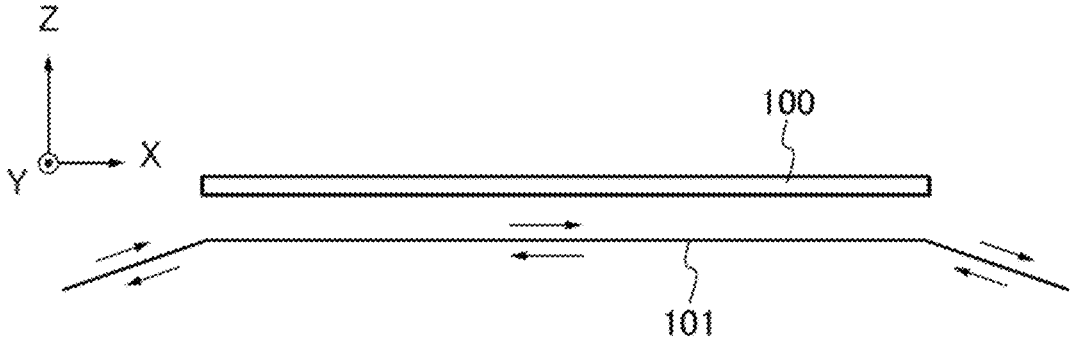

FIG. 9 is a flowchart illustrating a control of the drawing operation according to the present embodiment. FIGS. 10A and 10B are schematic diagrams illustrating a movement trajectory of the carriage 1 according to the present embodiment. FIG. 10A is a front view, and FIG. 10B is a plan view of the movement trajectory of the carriage 1. The movement trajectory of the carriage 1 is indicated by arrow 1R in FIG. 10A.

When the controller 500 receives a drawing command, the controller 500 controls the X-direction driver 72, the Y-direction driver 82, and the Z-direction driver 92 illustrated in FIGS. 1A and 1B to move the carriage 1 to a drawing-start standby position 110 (PS1).

The drawing-start standby position 110 (left end in FIG. 10A) is a position away from a drawing area (central area in FIG. 10A) of the object 100 by a certain distance in the —X direction and is a position away from a drawing surface of the object 100 in the —Z direction (see FIG. 10B). As illustrated in FIG. 10B, a distance of the drawing-start standby position 110 from the drawing surface of the object 100 is larger than a distance of a region of the X-axis rail 101 where the carriage 1 is positioned during the drawing operation (central area in FIG. 10B) from the drawing surface of the object 100 in the Z-axis direction.

The controller 500 performs a maintenance operation at the drawing-start standby position 110 (PS2). Details of the maintenance operation is described later. Then, the controller 500 controls the X-direction driver 72 and the Z-direction driver 92 to move the carriage 1 in the +X direction while moving the carriage 1 close to the drawing surface of the object 100 as illustrated in FIG. 10B to perform the drawing operation based on image data (PS3). When the carriage 1 moves out of the drawing area, the controller 500 controls the X-direction driver 72 and the Z-direction driver 92 to move the carriage 1 in the +X direction while moving the carriage 1 away from the drawing surface of the object 100 in the —Z direction and stop the carriage 1 at a reversal position 111 (see FIG. 10B).

The controller 500 determines whether the drawing operation is finished (PS4). If there is remaining drawing data, the controller 500 controls the Y-direction driver 82 to move the carriage 1 in the —Y direction (PS5). Then, the controller 500 performs again the operations in steps PS2 to PS4. The controller 500 continues the operations in steps PS2 to PS5 until the drawing is finished. When the controller 500 determines that the drawing is finished in the step PS4, the controller 500 performs the maintenance operation similarly to the step PS2 (PS6). As a result, the operation can be finished in a state where the residual ink is removed from the nozzle plate face 302*a*.

Figure 11A:
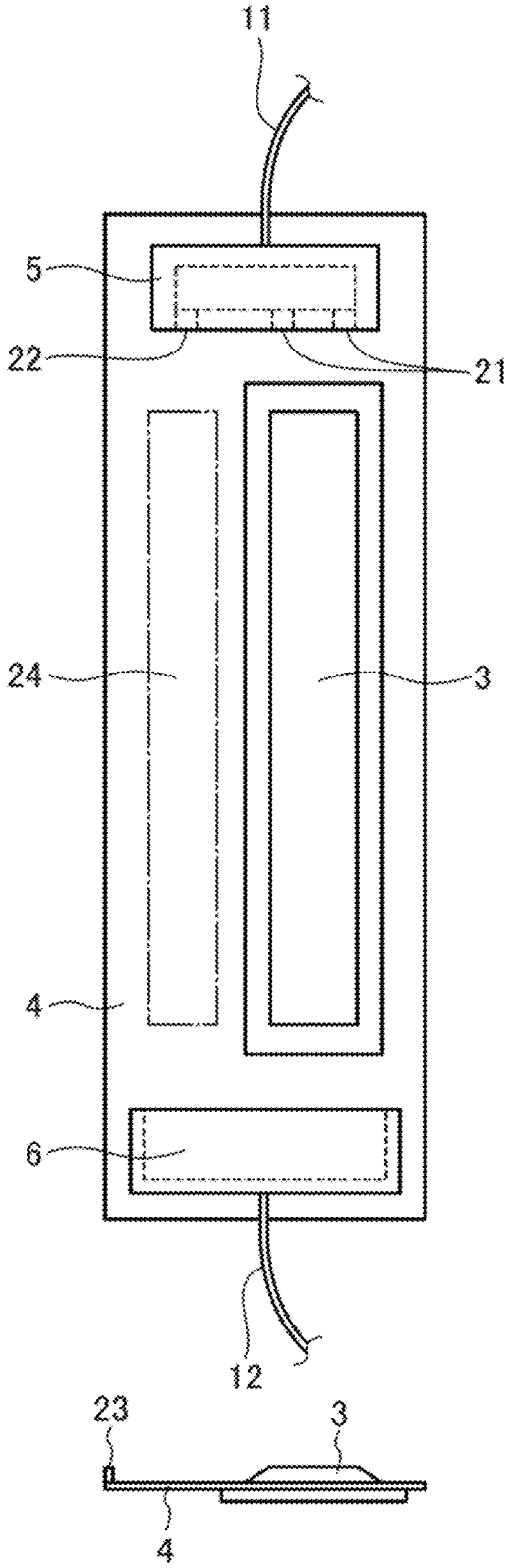
FIGS. 11A and 11B are schematic views of a wiper unit according to the present embodiment.
Figure 11B:
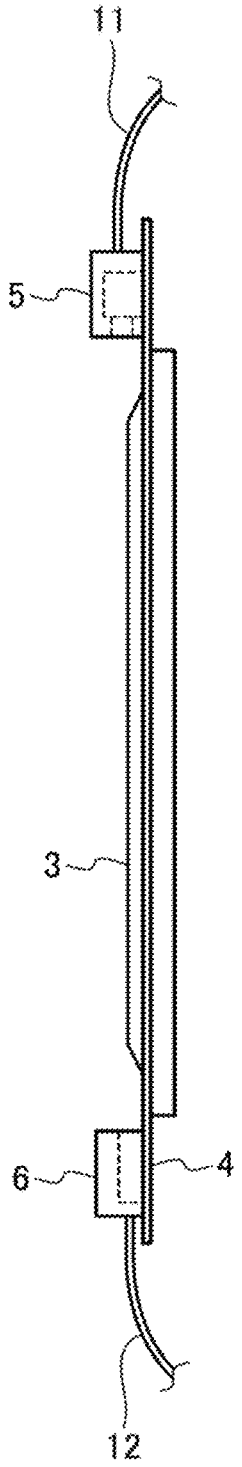
Figure 12A:
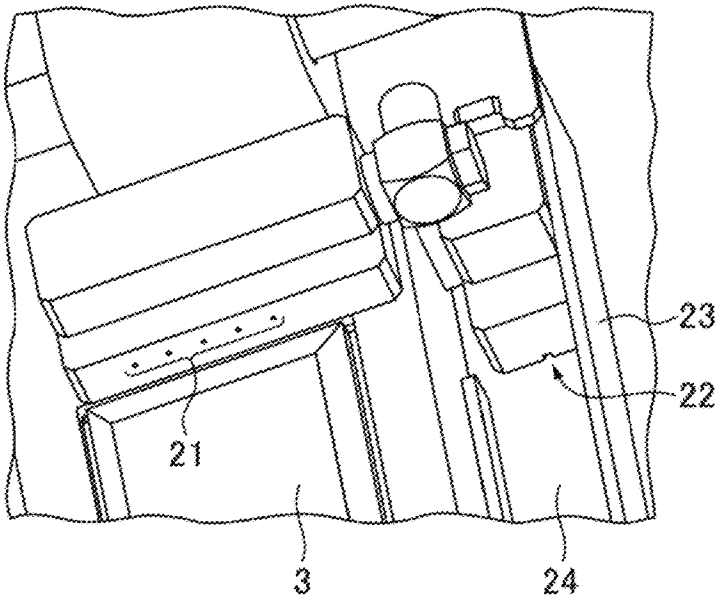
FIGS. 12A to 12C are partial enlarged views of the wiper unit according to the present embodiment.
Figure 12B:
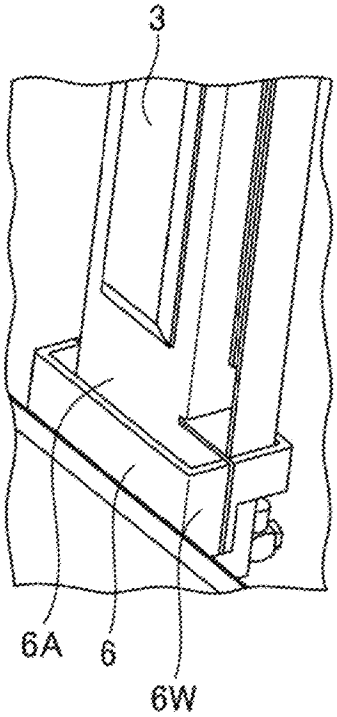
Figure 12C:
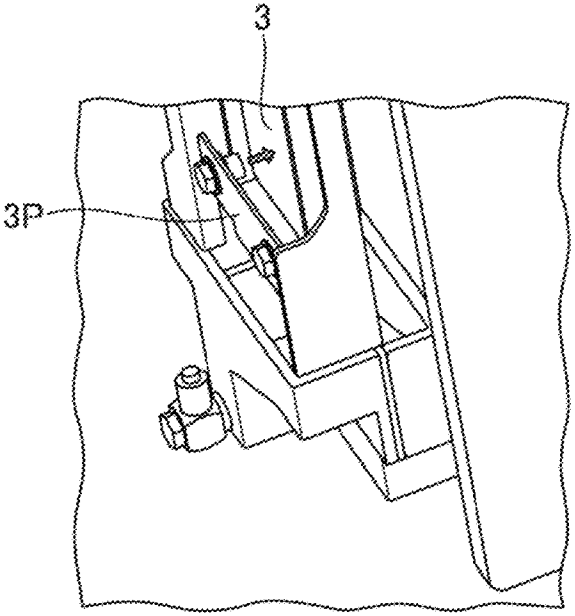

FIGS. 11A and 11B are schematic views of the wiper unit 4 according to the present embodiment. FIGS. 12A to 12C are partial enlarged views of the wiper unit 4 according to the present embodiment. FIG. 11A is a rear view of the wiper unit 4. FIG. 11B is a side view of the wiper unit 4. FIG. 12A is an enlarged upper front perspective view of a portion of the wiper unit 4. FIG. 12B is an enlarged lower front perspective view of a portion of the wiper unit 4. FIG. 12C is an enlarged lower rear perspective view of a portion of the wiper unit 4.

The wiper unit 4 includes a convex portion 23 and a pressure mechanism 3P. The convex portion 23 protrudes from the ink receiving surface 24 in the normal direction of the ink receiving surface 24 and extends in the direction parallel to the ink receiving surface 24 and downward in the vertical direction. The pressure mechanism 3P presses the wiper 3 from a rear side of the wiper 3 as indicated by arrow in FIG. 12C. The wiper 3 and the convex portion 23 are examples of a protrusion that protrude toward the nozzle 302 from the ink receiving surface 24 in the state in which the ink receiving surface 24 faces the nozzle 302.

The ink receiving surface 24 is arranged between the wiper 3 and the convex portion 23 in the horizontal direction. The wiper 3 and the convex portion 23 extend downward in the vertical direction. As illustrated in FIGS. 2 to 4, the wiper unit 4 moves in the horizontal direction (X-axis direction). That is, the wiper 3 and the convex portion 23 are examples of a first protrusion and a second protrusion that are disposed across the ink receiving surface 24 in the moving direction of the wiper unit 4 and extend in the direction perpendicular to the moving direction of the wiper unit 4. The wiper 3 has a slope in each of four sides of the wiper 3 from a wiping surface of the wiper 3 that faces the nozzle plate face 302*a* of the heads 300 as the highest point of the wiper 3.

The cleaning liquid supplier 5 is disposed above the wiper 3 and the ink receiving surface 24. The cleaning liquid supplier 5 includes a wiper-side supply port 21 and a receiving-side supply port 22. The wiper-side supply port 21 supplies the cleaning liquid from above the wiper 3. The receiving-side supply port 22 supplies the cleaning liquid from above the ink receiving surface 24. The cleaning liquid collector 6 is disposed below the wiper 3 and the ink receiving surface 24. The cleaning liquid collector 6 has a wall surface 6W surrounding a space above a bottom surface of the cleaning liquid collector 6. An opening 6A surrounded by the wall surface 6W is formed at an upper portion of the cleaning liquid collector 6. In the case in which the head 300 discharges ink downward in the vertical direction with respect to the ink receiving surface 24 from the nozzle 302, the cleaning liquid collector 6 may be integral with the ink receiving surface 24 instead of being disposed below the ink receiving surface 24.

As described above, the wiper unit 4 includes the convex portion 23 and the wiper 3 that protrude toward the nozzle 302 from the ink receiving surface 24 and extend in the direction parallel to the ink receiving surface 24 in the state in which the ink receiving surface 24 faces the nozzle 302. Thus, the wiper unit 4 can prevent the ink received by the ink receiving surface 24 from scattering around the ink receiving surface 24.

Further, the wiper unit 4 includes the convex portion 23 (first protrusion), the wiper 3 (second protrusion), and the ink receiving surface 24 arranged between the convex portion 23 (first protrusion) and the wiper 3 (second protrusion) in the moving direction of the wiper unit 4 (in the horizontal direction). The first protrusion (convex portion 23) and the second protrusion (wiper 3) extend in the direction perpendicular to the moving direction of the wiper unit 4. Thus, the wiper unit 4 can reliably prevent the ink received by the ink receiving surface 24 from scattering around the ink receiving surface 24.

Figure 13:
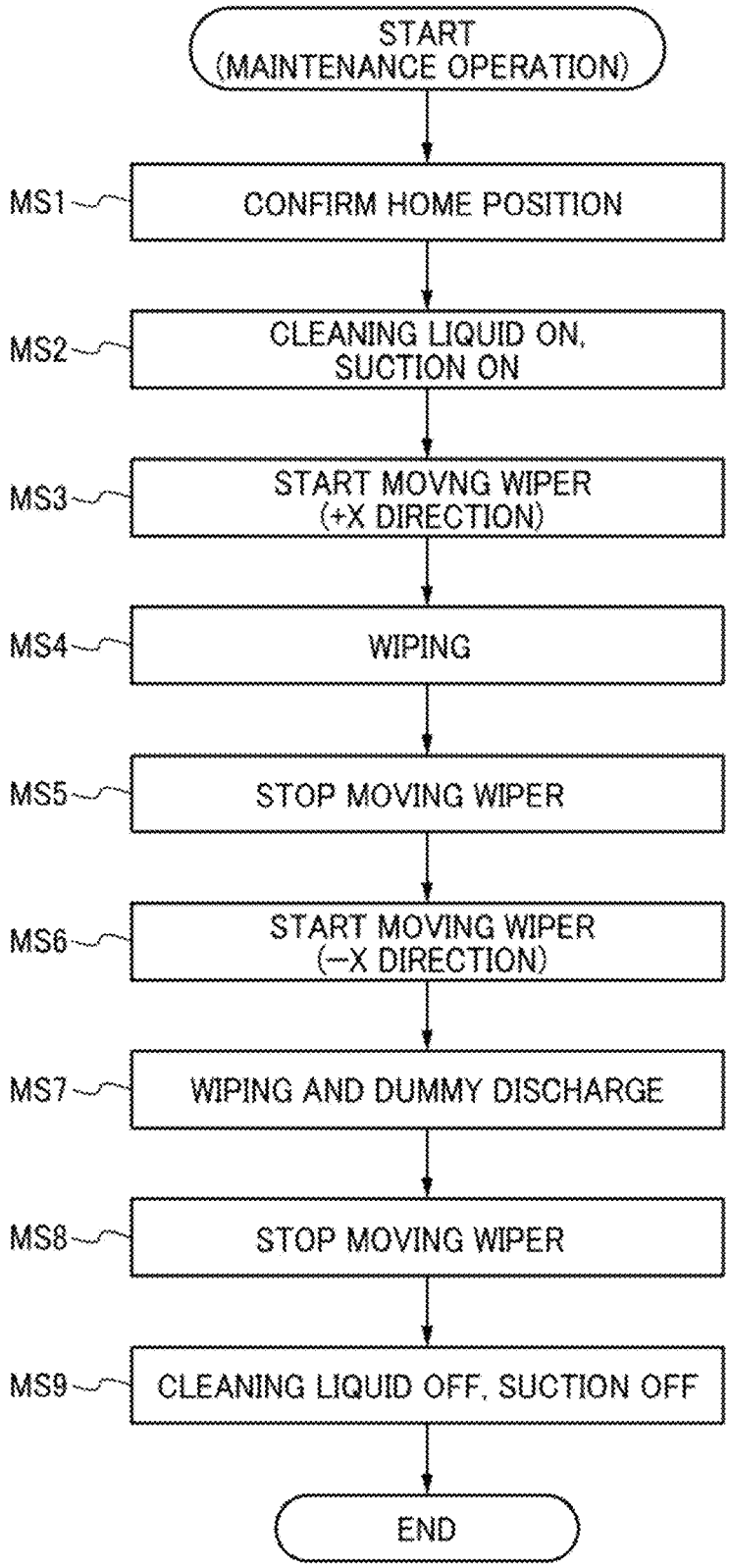
FIG. 13 is a flowchart illustrating a control of a maintenance operation according to the present embodiment.
Figure 14:
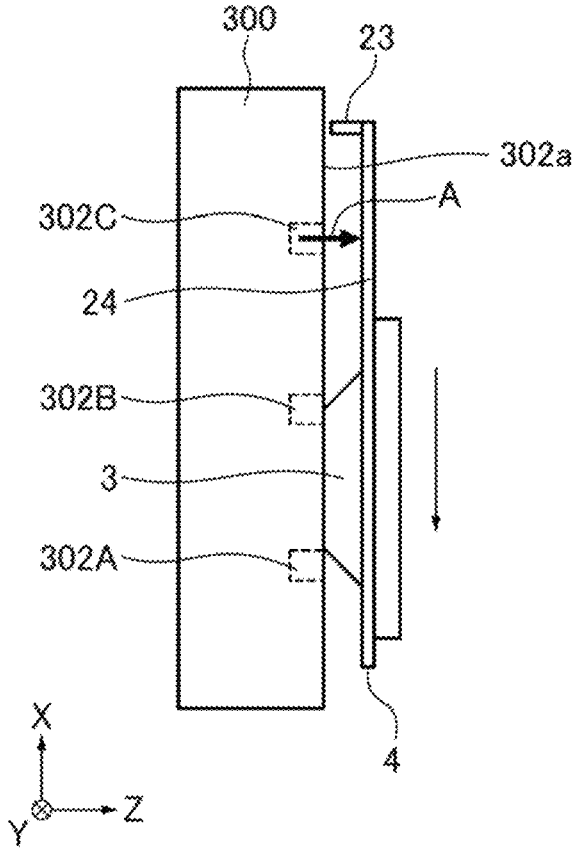
FIG. 14 is a schematic view of the wiper unit for explaining the maintenance operation according to the present embodiment.

FIG. 13 is a flowchart illustrating a control of the maintenance operation according to the present embodiment. FIG. 14 is a schematic view of the wiper unit 4 and the head 300 for explaining the maintenance operation according to the present embodiment. The controller 500 determines whether the wiper unit 4 is at the home position based on the detection signal of the sensor 17*a* (MS1). The controller 500 opens the valve 234 to supply the cleaning liquid 220 from the cleaning liquid supplier 5. At the same time, the controller 500 opens the solenoid valve 244 to activate the vacuum generator 242 so that the cleaning liquid collector 6 becomes a vacuum state (MS2).

The controller 500 drives the motor 13 to move the wiper unit 4 in the +X direction as illustrated in FIGS. 2 and 3, and moves the wiper unit 4 to the facing position where the wiper 3 faces the nozzle plate face 302*a* (MS3). The controller 500 further moves the wiper unit 4 in the +X direction while wiping the nozzle plate face 302*a* with the wiper 3 in the state in which the wiper 3 faces the nozzle plate face 302*a* (MS4). When the controller 500 determines that the wiper unit 4 has reached the moving end position based on the detection signal from the sensor 17*b*, the controller 500 stops the motor 13 and stops moving the wiper unit 4 (MS5).

Next, the controller 500 drives the motor 13 in a reverse direction to move the wiper unit 4 in the reverse direction (—X direction) so that the wiper unit 4 moves to the facing position where the wiper 3 faces the nozzle plate face 302*a* and the ink receiving surface 24 faces the nozzle 302 (MS6). The controller 500 moves the wiper unit 4 further in the —X direction while the wiper 3 facing the nozzle plate face 302*a*, and the wiper unit 4 wipes the nozzle plate face 302*a* with the wiper 3. Then, the controller 500 causes the heads 300 to discharge ink toward the ink receiving surface 24 from the nozzle 302 (dummy discharge) after the wiper 3 passes (wipes) the nozzle 302 (MS7).

Specifically, as illustrated in FIG. 14, the controller 500 causes the head 300 to discharge ink toward the ink receiving surface 24 from the nozzle 302C as indicated by arrow A after the wiper 3 passes through the nozzle 302C and before the convex portion 23 passes the nozzle 302C. Conversely, in a state as illustrated in FIG. 14, the nozzle 302B is wiped by the wiper 3, the nozzle 302A is before wiping by the wiper 3, and neither the nozzle 302A nor the nozzle 302B faces the ink receiving surface 24. Thus, the controller 500 causes the head 300 not to discharge ink from the nozzles 302A and 302B.

When the controller 500 determines that the wiper unit 4 has reached the standby position (home position) based on the detection signal from the sensor 17*a*, the controller 500 stops the motor 13 and stops moving the wiper unit 4 (MS8). The controller 500 closes the valve 234 to stop supplying the cleaning liquid 220 to the wiper 3 and the ink receiving surface 24 from the cleaning liquid supplier 5 and closes the solenoid valve 244 to stop the vacuum state of the cleaning liquid collector 6 (MS9).

As described above, when the wiper unit 4 moves in the state in which the ink receiving surface 24 faces the nozzles 302 (i.e., at least one of the nozzles 302), the wiper 3 contacts the nozzles 302 (i.e., at least another of the nozzles 302) and the nozzle plate face 302*a* in which the nozzles 302 are formed. Thus, the wiper 3 contacts the nozzles 302 and the nozzle plate face 302*a* when the wiper unit 4 moves, and the wiper 3 thus can wipe and clean the nozzles 302 and the nozzle plate face 302*a*.

The liquid discharge apparatus 1000 includes the controller 500 that causes the head 300 to discharge ink from the nozzle 302 toward the ink receiving surface 24 after the wiper 3 passes through the nozzle 302 during the movement of the wiper unit 4. Thus, the liquid discharge apparatus 1000 can remove foreign matter and the like from the nozzle 302 and reliably discharge ink from the nozzle 302 toward the ink receiving surface 24.

Figure 15B:
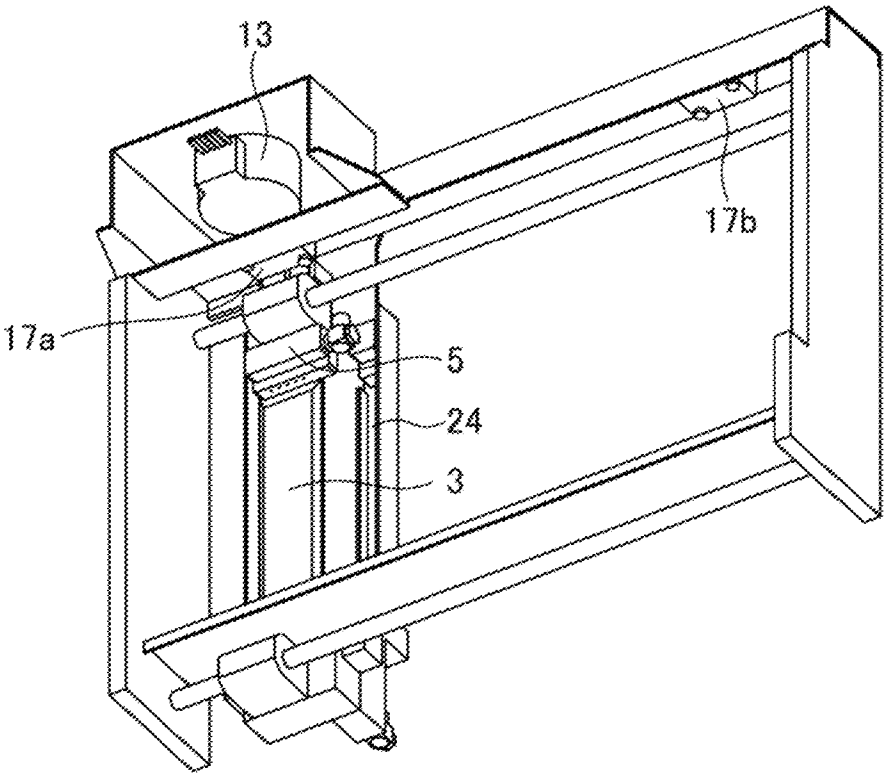
FIGS. 15A and 15B are perspective views of a wiper unit according to a first variation of the present embodiment.
Figure 15A:
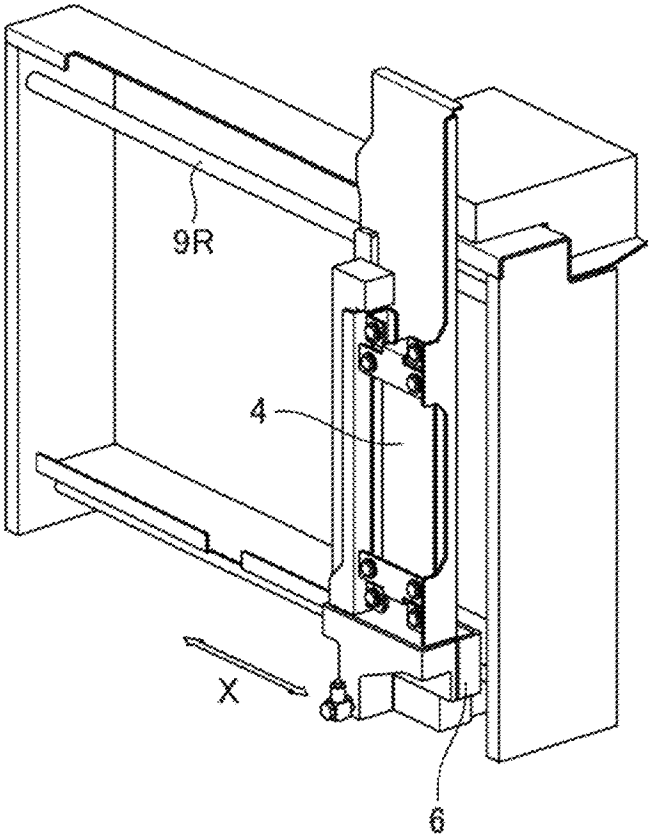

FIGS. 15A and 15B are perspective views of a wiper unit 4 according to a first variation of the present embodiment. In the above embodiment illustrated in FIG. 3, the wiper unit 4 moves along the trajectory along the shape of the guide grooves 9. In the first variation illustrated in FIGS. 15A and 15B, the wiper unit 4 moves in the direction parallel to the X-axis direction along a guide rail 9R. Also in the first variation, the controller 500 drives the motor 13 and transmits a rotational driving force of the motor 13 to the belts 14B and 14C via the belt 14A to move the wiper unit 4 coupled to the belts 14B and 14C as illustrated in FIG. 3. Thus, the wiper unit 4 moves along a trajectory along the guide rail 9R.

Figure 16A:
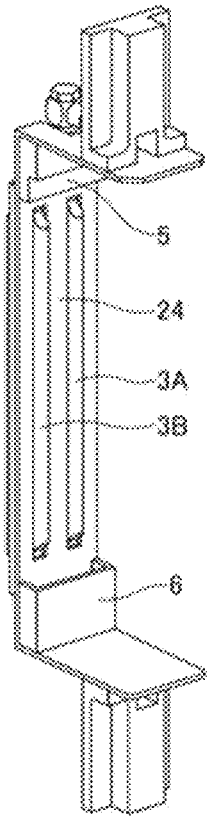
FIGS. 16A and 16B are perspective views of a wiper unit according to a second variation of the present embodiment.
Figure 16B:
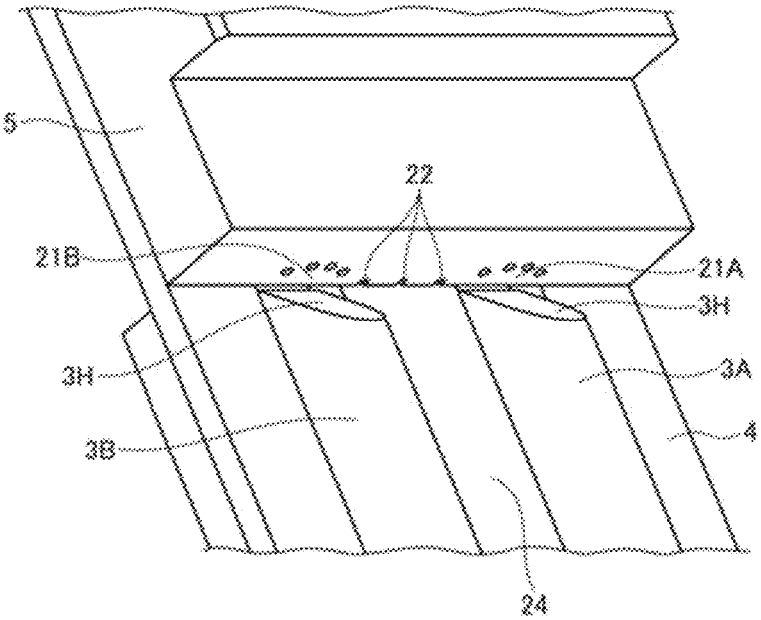

FIGS. 16A and 16B are perspective views of a wiper unit 4 according to a second variation of the present embodiment. In the above embodiment as illustrated in FIGS. 12A to 12C, the wiper unit 4 includes the wiper 3, the convex portion 23, and the ink receiving surface 24 arranged between the wiper 3 and the convex portion 23 in the horizontal direction. In the second variation illustrated in FIGS. 16A and 16B, the wiper unit 4 includes a first wiper 3A, a second wiper 3B, and the ink receiving surface 24 arranged between the first wiper 3A and the second wiper 3B in the horizontal direction.

The first wiper 3A and the second wiper 3B are examples of a first protrusion and a second protrusion that are disposed across the ink receiving surface 24 in the moving direction of the wiper unit 4 and extend in the direction perpendicular to the moving direction of the wiper unit 4. The first and second protrusions may be parts of the single wiper 3 instead of separate components such as the first wiper 3A and the second wiper 3B.

Each of the first wiper 3A and the second wiper 3B includes an upper surface 3H that is inclined such that the ink receiving surface 24 side of the upper surface 3H is positioned higher than the nozzle plate face 302*a* side of the upper surface 3H. That is, the upper surface 3H of each of the first and second wipers 3A and 3B is inclined downward toward the nozzle plate face 302*a* of the heads 300. The wiper-side supply port 21 includes a first supply port 21A facing the upper surface 3H of the first wiper 3A and a second supply port 21B facing the upper surface 3H of the second wiper 3B. Thus, the cleaning liquid easily flows toward the nozzle plate face 302*a* side of the first and second wipers 3A and 3B (simply referred to as the wipers 3).

The first supply port 21A and the second supply port 21B are arranged across the receiving-side supply port 22 in the moving direction of the wiper unit 4. As described above, the upper surface 3H of each of the wipers 3 is inclined such that the nozzle plate face 302*a* side of the upper surface 3H is lower than the ink receiving surface 24 side of the upper surface 3H. Thus, the cleaning liquid received by the upper surface 3H of the wipers 3 is reliably supplied to the nozzle plate face 302*a* side of the wipers 3. As a result, the wipers 3 thus can reliably wipe and clean the nozzle plate face 302*a* of the head 300.

Figure 17:
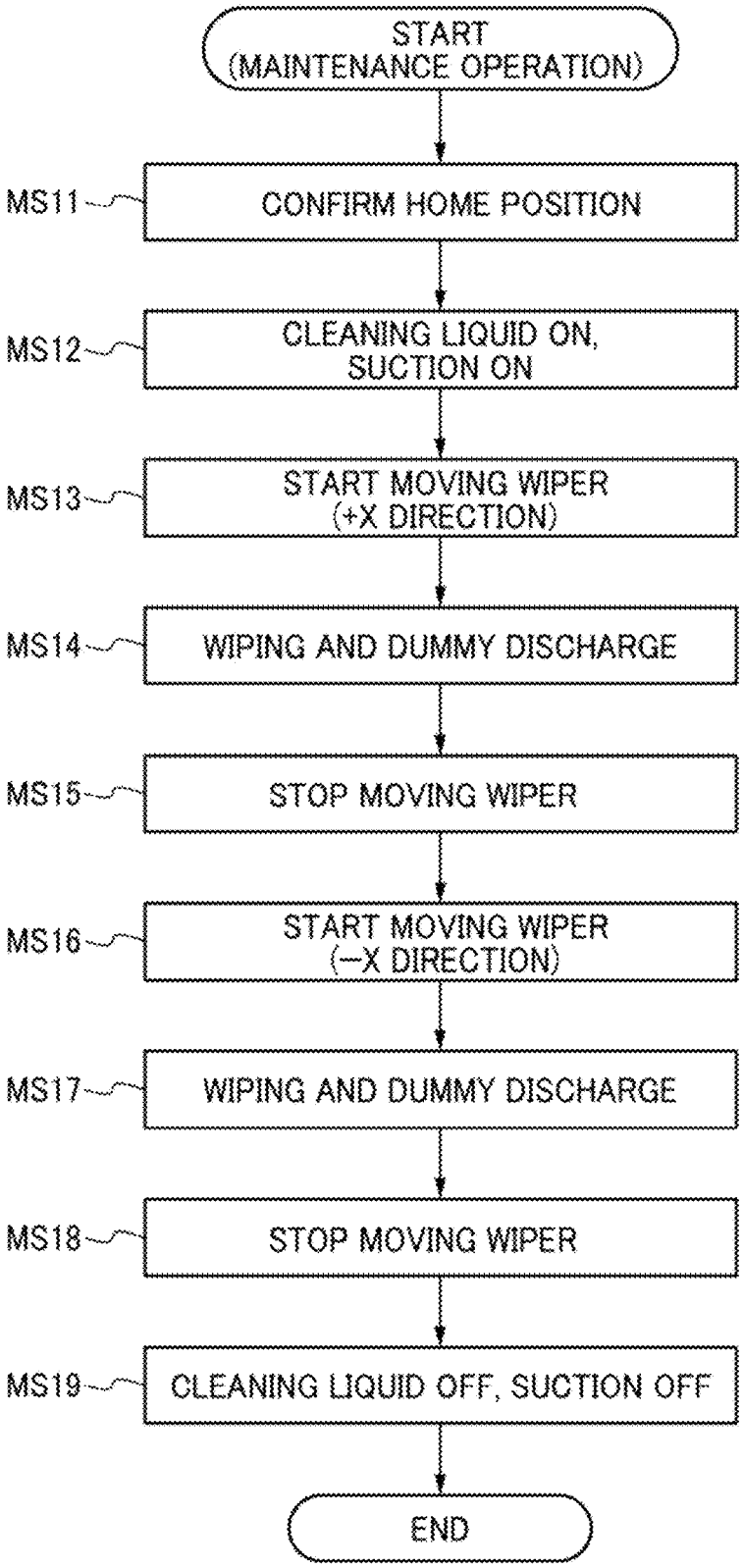
FIG. 17 is a flowchart illustrating a control of a maintenance operation according to the second variation.
Figure 18:
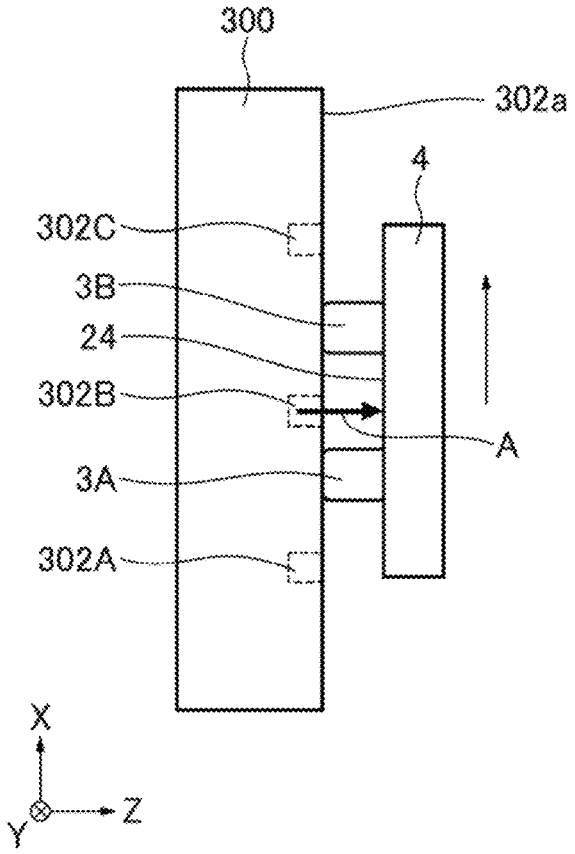
FIG. 18 is a schematic view of the wiper unit for explaining the maintenance operation according to the second variation.

FIG. 17 is a flowchart illustrating a control of a maintenance operation according to the second variation. FIG. 18 is a schematic view of the wiper unit 4 for explaining the maintenance operation according to the second variation. The controller 500 determines whether the wiper unit 4 is at the standby position (home position) based on the detection signal from the sensor 17*a* (MS11). The controller 500 opens the valve 234 to supply the cleaning liquid 220 from the cleaning liquid supplier 5 and also opens the solenoid valve 244 to activate the vacuum generator 242 to bring the cleaning liquid collector 6 into the vacuum state (MS12).

The controller 500 drives the motor 13 to move the wiper unit 4 in the +X direction and moves the wiper unit 4 to the facing position where the wipers 3 face the nozzle plate face 302*a* of the head 300 and the ink receiving surface 24 faces the nozzle 302 (MS13). The controller 500 moves the wiper unit 4 further in the +X direction while the wipers 3 facing the nozzle plate face 302*a*, and the wiper unit 4 wipes the nozzle plate face 302*a* with the wipers 3. Then, the controller 500 causes the head 300 to discharge ink toward the ink receiving surface 24 from the nozzle 302 (dummy discharge) after the wiper 3 (second wiper 3B) passes (wipes) the nozzle 302 (MS14).

Specifically, as illustrated in FIG. 18, the controller 500 causes the head 300 to discharge ink toward the ink receiving surface 24 from the nozzle 302B as indicated by arrow A after the second wiper 3B passes the nozzle 302B and before the first wiper 3A passes the nozzle 302B. Conversely, in the state as illustrated in FIG. 18, the nozzle 302A is after wiping by the first wiper 3A, the nozzle 302C is before wiping by the second wiper 3B, and neither the nozzle 302A nor the nozzle 302C faces the ink receiving surface 24. Thus, the controller 500 causes the head 300 not to discharge ink from the nozzles 302A and 302C. When the controller 500 determines that the wiper unit 4 has reached the moving end position based on the detection signal from the sensor 17*b*, the controller 500 stops the motor 13 and stops moving the wiper unit 4 (MS15).

Next, the controller 500 drives the motor 13 in a reverse direction to move the wiper unit 4 in the reverse direction (—X direction) so that the wiper unit 4 moves to the facing position where the wipers 3 face the nozzle plate face 302*a* and the ink receiving surface 24 faces the nozzle 302 (MS16). Similarly to step MS14, the controller 500 moves the wiper unit 4 further in the —X direction while the wipers 3 facing the nozzle plate face 302*a*, and the wiper unit 4 wipes the nozzle plate face 302*a* with the wipers 3. Then, the controller 500 causes the head 300 to discharge ink toward the ink receiving surface 24 from the nozzle 302 (dummy discharge) after the wiper 3 (first wiper 3A) passes (wipes) the nozzle 302 (MS17).

When the controller 500 determines that the wiper unit 4 has reached the standby position (home position) based on the detection signal from the sensor 17*a*, the controller 500 stops the motor 13 and stops moving the wiper unit 4 (MS18). The controller 500 closes the valve 234 to stop supplying the cleaning liquid 220 to the wipers 3 from the cleaning liquid supplier 5 and closes the solenoid valve 244 to stop the vacuum state of the cleaning liquid collector 6 (MS19).

Figure 19A:
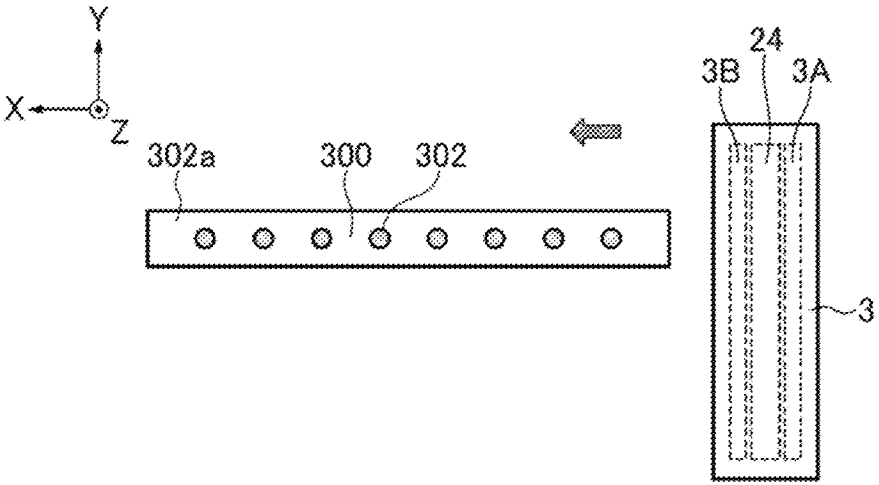
FIGS. 19A to 19D are schematic views of the wiper unit for explaining the maintenance operation according to the second variation.
Figure 19B:
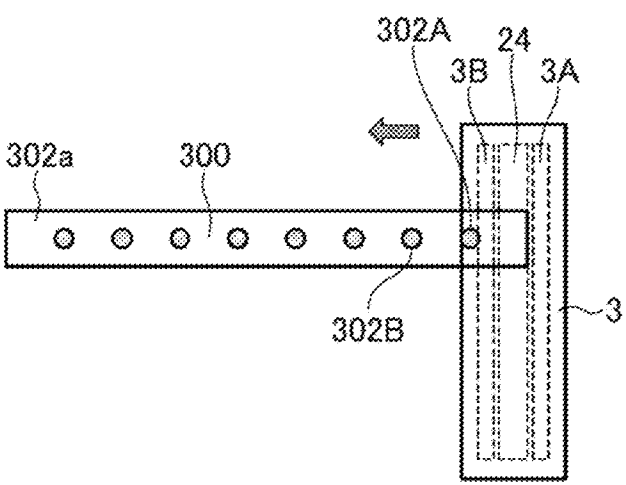
Figure 19C:
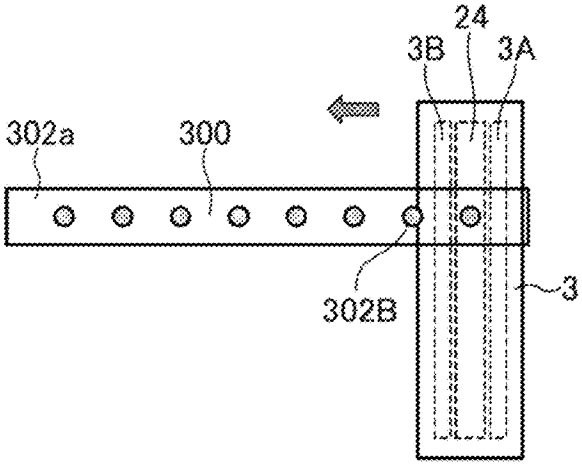
Figure 19D:
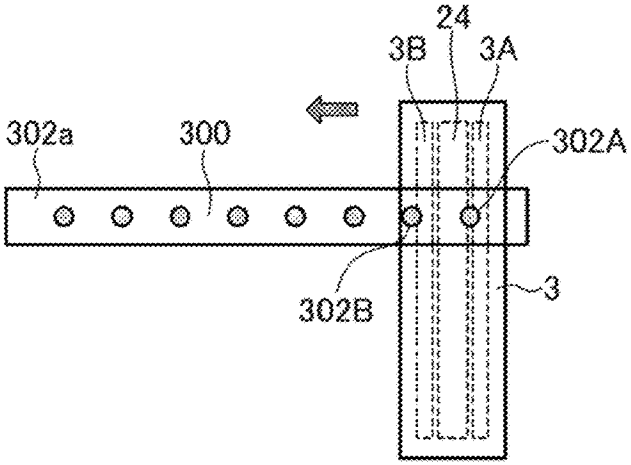

FIGS. 19A to 19D are a schematic view of the wiper unit 4 for explaining the maintenance operation according to the second variation. FIG. 19A corresponds to the step MS13 in the flowchart in FIG. 17 and illustrates a state in which the wiper unit 4 does not face the nozzle plate face 302*a*. FIGS. 19B to 19D correspond to the step MS14 in the flowchart in FIG. 17 and illustrate a state in which the wiper unit 4 faces the nozzle plate face 302*a*.

In a state illustrated in FIG. 19B, the second wiper 3B faces the nozzle plate face 302*a* and the nozzle 302A, and the second wiper 3B wipes and cleans the nozzle plate face 302*a* and the nozzle 302A while moving in the +X direction. That is, the second wiper 3B passes (wipes) the nozzle 302A and is before passing (wiping) the nozzle 302B, and neither the nozzle 302A nor the nozzle 302B faces the ink receiving surface 24. Therefore, the controller 500 causes the head 300 not to discharge ink from the nozzles 302A and 302B.

In a state illustrated in FIG. 19C, the second wiper 3B and the first wiper 3A face the nozzle plate face 302*a* and wipe and clean the nozzle plate face 302*a* while moving in the +X direction. Further, the controller 500 causes the head 300 to discharge ink from the nozzle 302A since the nozzle 302A faces the ink receiving surface 24. Conversely, the controller 500 causes the head 300 not to discharge ink from the nozzle 302B since the second wiper 3B is before passing (wiping) the nozzle 302B and the ink receiving surface 24 does not face the nozzle 302B.

In a state illustrated in FIG. 19D, the second wiper 3B faces the nozzle plate face 302*a* and the nozzle 302B, and the second wiper 3B wipes and cleans the nozzle plate face 302*a* and the nozzle 302B while moving in the +X direction. Further, the first wiper 3A faces the nozzle plate face 302*a* and the nozzle 302A and wipes and cleans the nozzle plate face 302*a* and the nozzle 302A while moving in the +X direction. That is, the second wiper 3B passes (wipes) the nozzle 302B, the first wiper 3A passes (wipes) the nozzle 302A, and neither the nozzle 302A nor the nozzle 302B faces the ink receiving surface 24. Therefore, the controller 500 causes the head 300 not to discharge ink from the nozzle 302A and the nozzle 302B.

As described above, the controller 500 causes the head 300 to sequentially discharge ink to the ink receiving surface 24 from the respective nozzles 302 that face the ink receiving surface 24 in synchronization with the movement of the wiper unit 4. Thus, as illustrated in FIG. 19B, the second wiper 3B wipes the nozzle 302A before the ink is discharged onto the ink receiving surface 24 from the nozzle 302A to temporarily clean a surface environment of the nozzle 302A. Subsequently, as illustrated in FIG. 19C, the controller 500 causes the head 300 to discharge ink from the nozzle 302A onto the ink receiving surface 24 to purge dried ink from the nozzle 302A. Then, as illustrated in FIG. 19D, the first wiper 3A wipes the nozzle 302A after the ink is discharged onto the ink receiving surface 24 from the nozzle 302A. Thus, the dried ink can be removed from the nozzle 302A, and the nozzle 302A can be completely cleaned. Thus, the cleaning operation as described above is performed twice in a forward path and a return path to stably maintain the nozzles 302 in a normal state (clean condition).

Figure 20:
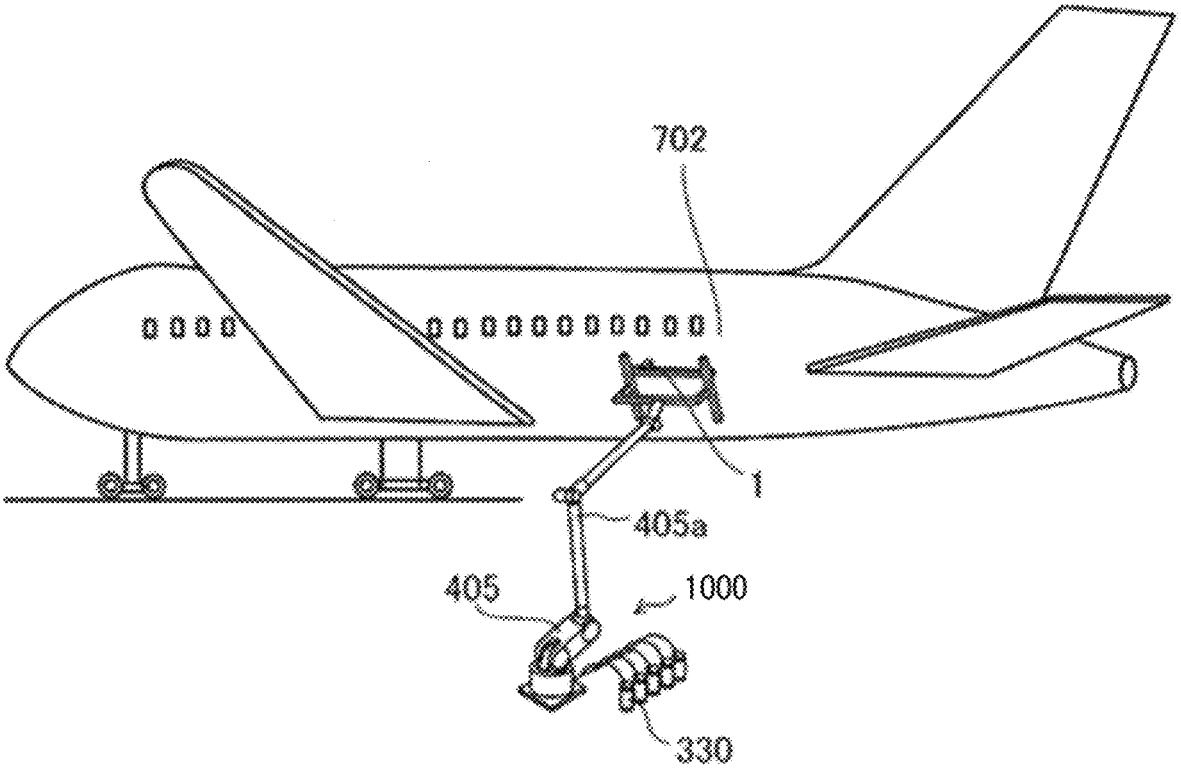
FIG. 20 is a schematic perspective view of a liquid discharge apparatus according to a third variation of the present disclosure, in which an aircraft is a target object by the liquid discharge apparatus.
Figure 21:
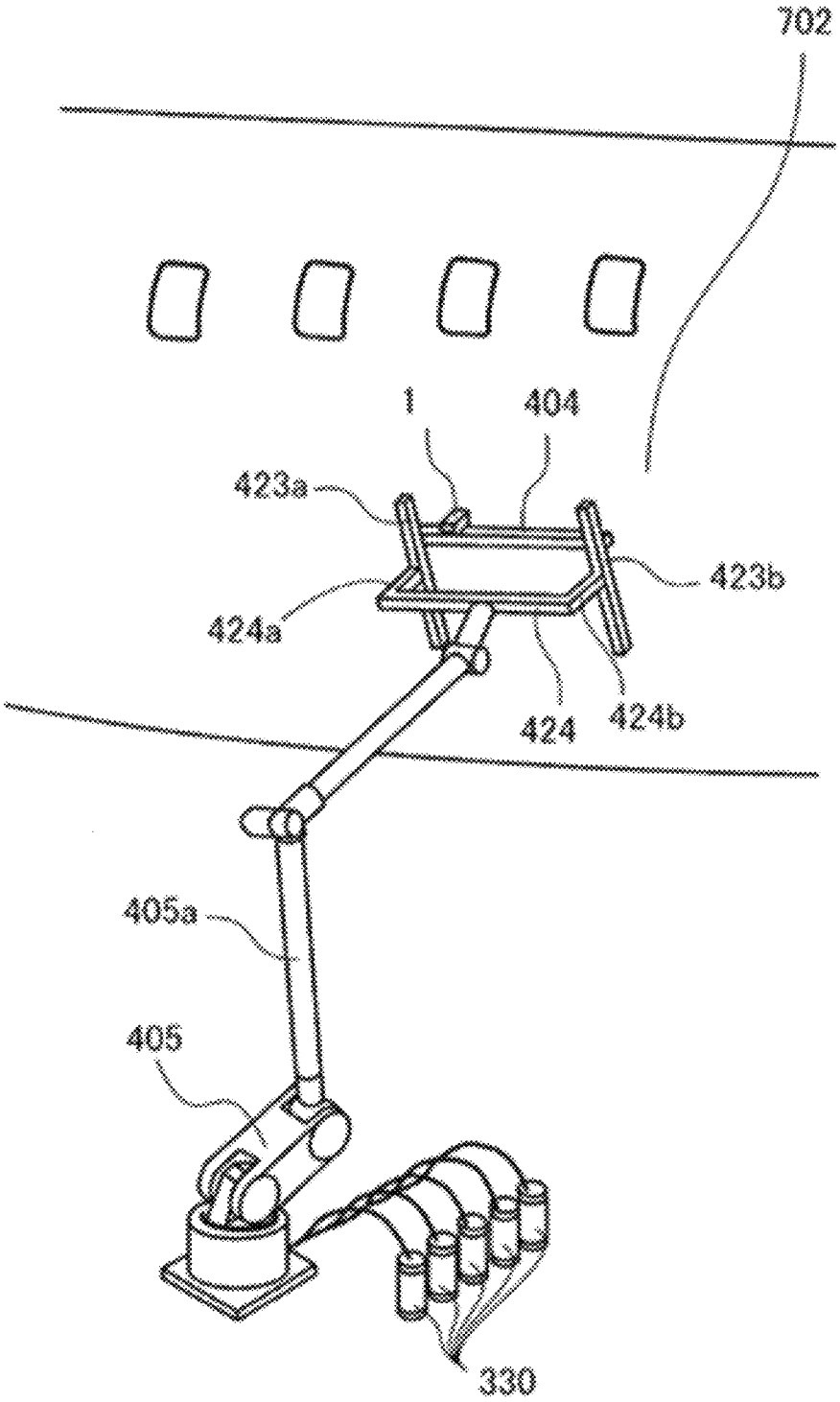
FIG. 21 is an enlarged perspective view of the liquid discharge apparatus according to the third variation.

FIG. 20 is a schematic perspective view of a liquid discharge apparatus 1000 according to a third variation of the present disclosure. In FIG. 20, an aircraft is a target object 702 on which the liquid discharge apparatus 1000 draws images. FIG. 21 is an enlarged perspective view of the liquid discharge apparatus 1000 according to the third variation.

The liquid discharge apparatus 1000 includes a linear rail 404 and a multi-articulated robot 405. The linear rail 404 guides the carriage 1 that reciprocally and linearly moves along the linear rail 404. The multi-articulated robot 405 appropriately moves the linear rail 404 to a predetermined position and holds the linear rail 404 at the predetermined position. The multi-articulated robot 405 includes a robot arm 405*a* that is freely movable like a human arm by a plurality of joints. The multi-articulated robot 405 can freely move a leading end of the robot arm 405*a* and arrange the leading end of the robot arm 405*a* at an accurate position. An industrial robot of a six-axis control-type having six axes (six joints) can be used as the multi-articulated robot 405, for example. According to the multi-articulated robot 405 of the six-axis control-type, it is possible to previously teach data related to a movement of the multi-articulated robot 405. As a result, the multi-articulated robot 405 can accurately and quickly position the linear rail 404 at a predetermined position facing the target object 702 (aircraft). The number of axes of the multi-articulated robot 405 is not limited to six, and a multi-articulated robot having an appropriate number of axes such as five axes or seven axes can be used.

The liquid discharge apparatus 1000 includes a fork-shaped support 424 bifurcated into two is provided on the robot arm 405*a* of the multi-articulated robot 405. The liquid discharge apparatus 1000 further includes a vertical linear rail 423*a* attached to a tip of a left branch 424*a* of the support 424, and a vertical linear rail 423*b* attached to a tip of a right branch 424*b* of the support 424. The vertical linear rail 423*a* and the vertical linear rail 423*b* are parallel to each other. Further, both ends of the linear rail 404 that movably holds the carriage 1 are supported by the vertical linear rails 423*a* and 423*b* to bridge between two of the vertical linear rails 423*a* and 423*b*.

The carriage 1 includes the head 300 described with reference to FIG. 2 and the like, a plurality of heads 300 that discharges liquids of respective colors (e.g., black, cyan, magenta, yellow, and white), or a head 300 having a plurality of nozzle arrays. The liquids of respective colors are respectively supplied under pressure from the ink tanks 330 to the heads 300 or the nozzle arrays of the head 300 of the carriage 1 in the same manner as in the above-described liquid supply system illustrated in FIG. 8.

In the liquid discharge apparatus 1000, the multi-articulated robot 405 moves the linear rail 404 to a position where the linear rail 404 faces a desired drawing area of the target object 702, and the heads 300 are driven to draw images on the target object 702 while moving the carriage 1 along the linear rail 404 according to drawing data. When the liquid discharge apparatus 1000 ends drawing of one line, the liquid discharge apparatus 1000 causes the vertical linear rails 423*a* and 423*b* of the multi-articulated robot 405 to move the heads 300 of the carriage 1 from the one line to a next line.

The liquid discharge apparatus 1000 repeats the above-described operation to draw images on the desired drawing area of the target object 702. During the drawing operation, the carriage 1 including the wiper 3 can wipe and clean the nozzle plate face 302*a* of the head 300 with the wiper 3 at any time although a moving distance of the carriage 1 (head 300) increases. In the third variation, the wiper 3 wipes the nozzle 302 before and after the drawing operation of one line. Thus, the liquid discharge apparatus 1000 can continuously draw high quality images with small downtime.

Figure 22:
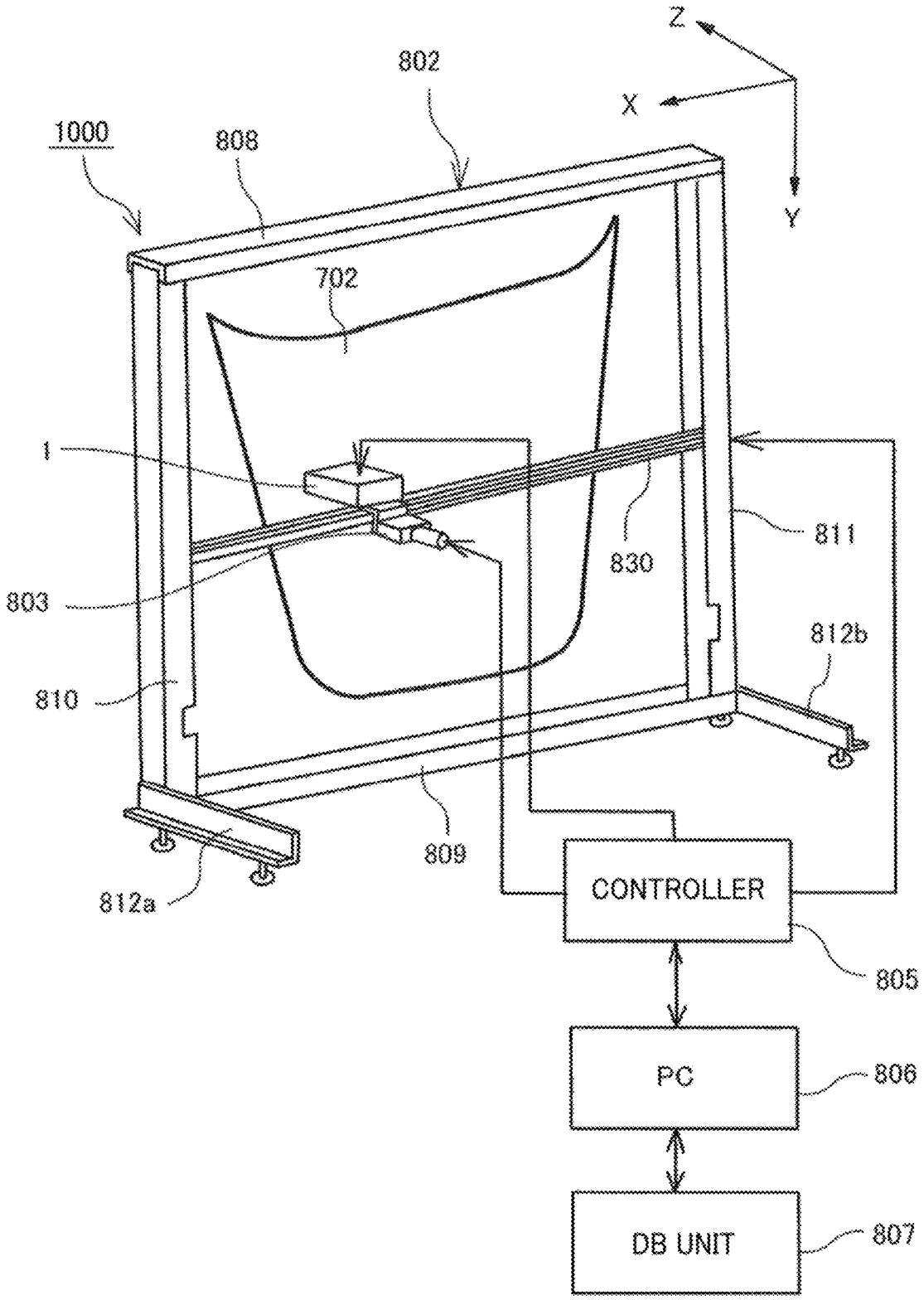
FIG. 22 is a perspective view of a liquid discharge apparatus according to a fourth variation of the present disclosure.
Figure 23:
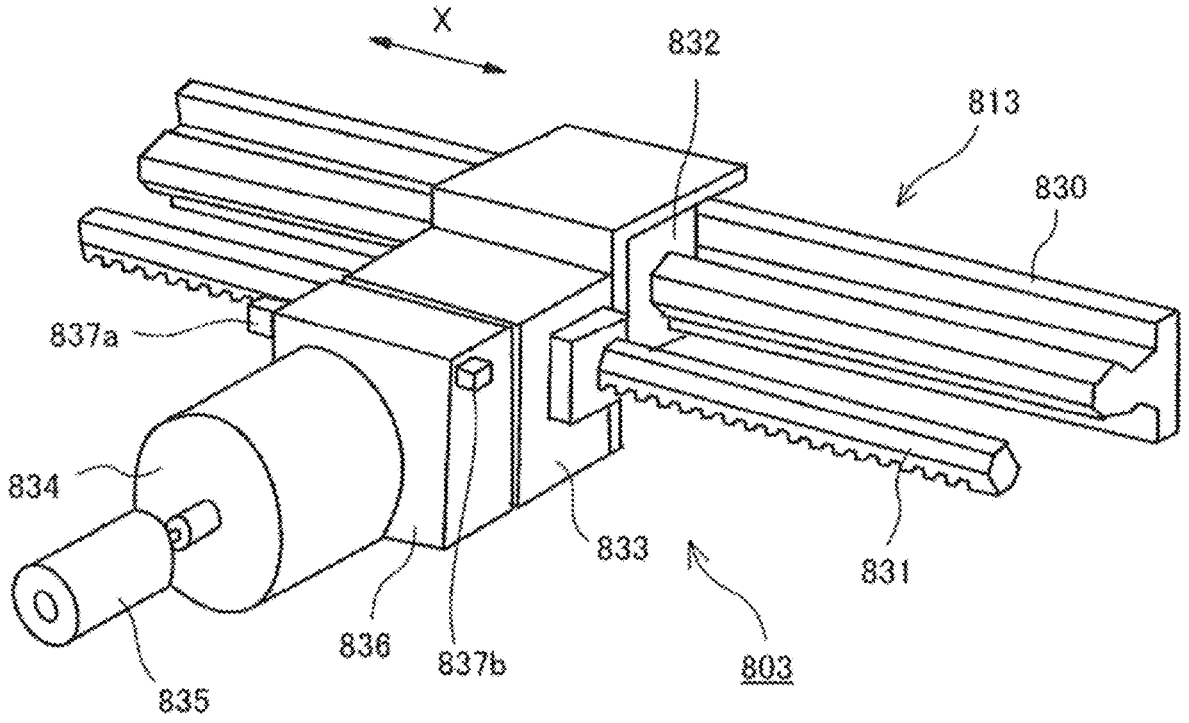
FIG. 23 is a perspective view of a driver of the liquid discharge apparatus according to the fourth variation.

FIG. 22 is a perspective view of a liquid discharge apparatus 1000 according to a fourth variation of the present disclosure. FIG. 23 is a perspective view of a driver of the liquid discharge apparatus 1000 according to the fourth variation.

The liquid discharge apparatus 1000 includes a movable frame unit 802 that is installed to face a target object 702 having a curved surface such as a hood of a vehicle. The frame unit 802 includes a left frame 810, a right frame 811, and a movable part 813. The movable part 813 is attached to the left frame 810 and the right frame 811 so that the movable part 813 is bridged between the left frame 810 and the right frame 811. The movable part 813 is vertically movable in the Y direction. The movable part 813 includes a driver 803 having a built-in motor and the carriage 1 attached to the driver 803. The driver 803 is reciprocally movable in the horizontal direction (X direction) on the movable part 813. The carriage 1 discharges a liquid toward the target object 702.

Further, the liquid discharge apparatus 1000 includes a controller 805 and a data processing device 806. The controller 805 controls a liquid discharge from carriage 1, a reciprocal movement of the driver 803, and a vertical movement of the movable part 813. The data processing device 806 such as a personal computer (PC) sends instructions to the controller 805. The data processing device 806 is connected to a database (DB) unit 807 that records and stores data related to the target object 702 such as a shape and a size of the target object 702.

The frame unit 802 further includes an upper frame 808 and a lower frame 809 in addition to the left frame 810 and the right frame 811 that form a vertical and horizontal outline of the frame unit 802. The upper frame 808, the lower frame 809, the left frame 810, and the right frame 811 are formed of metal pipes or the like. The frame unit 802 further includes a left leg 812*a* and a right leg 812*b* attached to both ends of the lower frame 809 to make the frame unit 802 to be freestanding. The left leg 812*a* and the right leg 812*b* are perpendicularly and horizontally attached to both the ends of the lower frame 809.

The movable part 813 bridged between the left frame 810 and the right frame 811 is vertically movable while supporting the driver 803. A surface of the target object 702 is perpendicular to the direction of liquid discharge (Z direction). Thus, the surface of the target object 702 faces a plane formed by the upper frame 808, the lower frame 809, the left frame 810, and the right frame 811 of the frame unit 802. In this case, in order to arrange the target object 702 at a predetermined position at which the drawing is to be performed, a back side of a drawing area of the target object 702 is sucked and held by a chuck attached to the leading end of the robot arm 405*a* of the multi-articulated robot 405, for example. By using the multi-articulated robot 405, the target object 702 can be accurately arranged at the drawing position, and the posture of the target object 702 can be appropriately changed.

As illustrated in FIG. 23, the driver 803 is reciprocally movable in the horizontal direction (X direction) along the movable part 813. The movable part 813 includes a rail 830, a rack gear 831, a linear guide 832, a pinion gear 833, a motor 834, and a rotary encoder 835. The rail 830 is horizontally disposed to bridge between the left frame 810 and the right frame 811 of the frame unit 802. The rack gear 831 is parallel to the rail 830. The linear guide 832 is fitted on a part of the rail 830 and slidably moves along the rail 830. The pinion gear 833 is coupled to the linear guide 832 and meshes with the rack gear 831. The motor 834 includes a decelerator 836 and drives to rotate the pinion gear 833. The rotary encoder 835 detects a position of a drawing point.

The motor 834 is forwardly or reversely driven to move the carriage 1 rightward or leftward along the movable part 813. Further, the driver 803 functions as a drive mechanism of the carriage 1 to move the carriage 1 in the X-axis direction. The decelerator 836 includes limit switches 837*a* and 837*b* attached to both sides of a case of the decelerator 836.

The carriage 1 includes the head 300 described with reference to FIG. 2 and the like, a plurality of heads 300 that discharges liquids of respective colors (e.g., black, cyan, magenta, yellow, and white), or a head 300 having a plurality of nozzle arrays. The liquids of respective colors are respectively supplied under pressure from the ink tanks 330 to the heads 300 or the nozzle arrays of the head 300 of the carriage 1 in the same manner as in the above-described liquid supply system illustrated in FIG. 8.

The liquid discharge apparatus 1000 moves the movable part 813 in the Y direction and moves the carriage 1 in the X direction so that desired images are drawn on the target object 702. During the drawing operation, the carriage 1 including the wiper 3 can wipe and clean the nozzle plate face 302*a* of the head 300 with the wiper 3 at any time although a moving distance of the carriage 1 (head 300) increases. Thus, the liquid discharge apparatus 1000 can continuously draw high quality images with small downtime.

Figure 24:
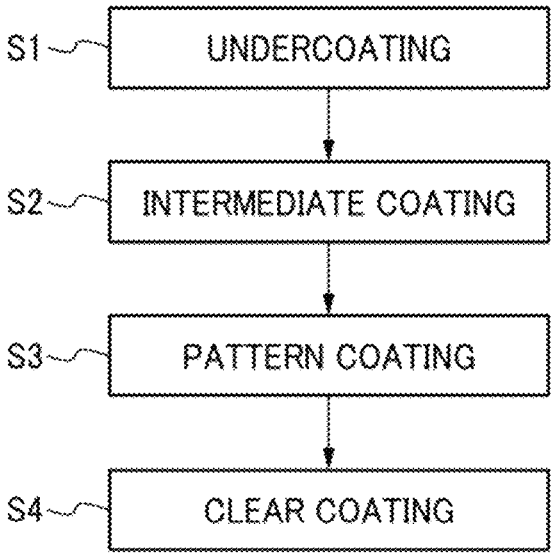
FIG. 24 is a flowchart illustrating a drawing operation according to the fourth variation.

FIG. 24 is a flowchart illustrating the drawing operation according to the fourth variation. In the fourth variation, the liquid discharge apparatus 1000 forms a pattern coating on the target object 702 such as an automobile body on which an undercoating and an intermediate coating are sequentially formed on a base material.

The base material used in the fourth variation may be any material without limitation as long as the base material can be used for the automobile body. As examples of the base material, there are metal bases such as steel plates, aluminum plates, galvanized steel plates, and iron-zinc alloy-plated steel plates; chemical conversion-treated metal bases obtained by subjecting the above-described metal bases to chemical conversion treatments such as chromate treatment, zinc phosphate treatment, and iron phosphate treatment; plastic bases such as a fiberglass reinforced plastic (FRP); and the like.

The undercoating is formed on the base material by a known method such as spray coating, immersion coating, and brush coating, for example. When the base material is a conductive base such as a metal base or a chemical conversion-treated metal base, it is preferable to form an electrodeposition coating using an electrodeposition painting as the undercoating (S1). To form an electrodeposition coating, the base material may be immersed in an electrodeposition bath by a known method and then subjected to electrodeposition coating. As the electrodeposition bath, any of known anion-type electrodeposition baths and cation-type electrodeposition baths can be used.

Examples of a base resin component of the electrodeposition bath include one type or two or more types of epoxy resin, acrylic resin, polybutadiene resin, alkyd resin, polyester resin, and silicone resin. As the anion-type electrodeposition bath, the base resin component includes an acid group such as a carboxyl group. As the cation-type electrodeposition bath, the base resin component includes an amino group and a basic group such as an ammonium group, a sulfonium group, an onium base group such as a phosphonium group. The above-described groups can be neutralized and ionized to make the above-described groups aqueous. The thickness of the undercoating is usually from 5 to 40 μm, preferably from about 15 to 30 μm, as a dry film thickness.

After undercoating, the undercoating is washed with water if necessary, and is air-dried or cured by baking. Then, an intermediate coating is applied on the undercoating (S2). The intermediate coating may be in any form of a water-based coating, an organic solvent-based coating, or a powder coating. Examples of a resin coating include various types of resin coatings such as alkyd resin, polyester resin, acrylic resin, polyurethane resin, and vinyl resin. Among the materials for the intermediate coating, alkyd resin materials are generally used.

In the fourth variation, the liquid discharge apparatus 1000 applies a coating of a predetermined pattern (pattern coating) that is previously set in the data processing device 806 onto an automobile body on which the undercoating and the intermediate coating as described above have been sequentially formed (S3). A pattern coating is usually a thin film having a thickness of about 1 to 10 μm, and it is necessary to contain a large amount of pigment in order to conceal the undercoating and the intermediate coating with the thin film. In the fourth variation, a clear coating is further applied on the pattern coating to solve the problems caused by the large amount of pigment contained in the pattern coating, for example, deterioration in appearance of coated surface caused by reduced gloss and deterioration in weather resistance and chemical resistance (S4).

The clear coating such as an organic solvent-based coating, an aqueous coating, a powder coating, or the like can be used without limitation as long as the clear coating has good weather resistance. Various resin coatings such as an acrylic resin, a polyester resin, an alkyd resin, a silicone resin, and a fluororesin can be used. The resin coating may be a thermosetting resin coating or resin coating cured by actinic rays such as ultraviolet rays and electron beams. The clear coating used as a top clear coating for automobiles are preferably used, and an acrylic resin-based thermosetting clear coating is particularly suitable.

As described above, according to an aspect of the present disclosure, the carriage 1 (an example of a liquid discharge device) includes the head 300 (an example of a head) that discharges ink (an example of a liquid) toward the object 100 (an example of an object) from the nozzle 302 (an example of a discharge port), the ink receiving surface 24 (an example of a liquid receiving surface) that receives the ink discharged from the nozzle 302, the cleaning liquid collector 6 (an example of a liquid collector) that holds and collects the ink received by the ink receiving surface 24, and the wiper unit 4 (an example of a moving unit) that holds the ink receiving surface 24 and the cleaning liquid collector 6. The wiper unit 4 is movable at the facing position where the ink receiving surface 24 faces the nozzle 302 without changing the inclination of the cleaning liquid collector 6 with respect to the horizontal plane.

Thus, the carriage 1 moves the ink receiving surface 24 to the facing position where the ink receiving surface 24 faces the nozzle 302 so that the ink receiving surface 24 can receive dried ink discharged from the nozzle 302 without moving the nozzle 302 of the head 300 with respect to the ink receiving surface 24. Further, it is possible to reduce a possibility in which the ink is shaken and overflown from the cleaning liquid collector 6 when the ink receiving surface 24 moves with respect to the nozzle 302.

The wiper unit 4 is movable at the facing position where the ink receiving surface 24 faces the nozzle 302 without changing the height of the cleaning liquid collector 6. In addition, the wiper unit 4 is movable in the horizontal direction at the facing position where the ink receiving surface 24 faces the nozzle 302. Thus, when the wiper unit 4 moves, the ink held by the cleaning liquid collector 6 do not receive a force in the height direction (direction of gravity). Thus, the ink held by the cleaning liquid collector 6 are less likely to be shaken and overflown from the cleaning liquid collector 6.

The wiper unit 4 is movable between the facing position where the ink receiving surface 24 faces the nozzle 302 and the position where the ink receiving surface 24 does not face the nozzle 302 in the horizontal direction or without changing the inclination of the cleaning liquid collector 6 with respect to the horizontal plane.

Thus, the carriage 1 moves the ink receiving surface 24 to the facing position where the ink receiving surface 24 faces the nozzle 302 so that the ink receiving surface 24 can receive dried ink discharged from the nozzle 302 without moving the nozzle 302 of the head 300 with respect to the ink receiving surface 24. Further, it is possible to reduce a possibility in which the ink is shaken and overflown from the cleaning liquid collector 6 when the ink receiving surface 24 moves to the position where the ink receiving surface 24 does not face the nozzle 302.

The carriage 1 includes the head fixing plate 7 and the upper and lower guide plates 8H and 8L that hold the nozzle 302 (nozzle plate face 302*a*) of the head 300 and movably supports the wiper unit 4, as the examples of the chassis.

The head 300 discharges ink from the nozzle 302 in the direction intersecting with the direction of gravity, and the cleaning liquid collector 6 is disposed below the ink receiving surface 24. Thus, the cleaning liquid collector 6 can hold the ink that is discharged toward the ink receiving surface 24 from the nozzle 302 of the head 300 and dropped to the cleaning liquid collector 6 under gravity.

The wiper unit 4 includes the convex portion 23 or the wiper 3 (an example of a protrusion) that protrudes toward the nozzle 302 from the ink receiving surface 24 and extends in the direction parallel to the ink receiving surface 24 in a state in which the ink receiving surface 24 faces the nozzle 302. Thus, the wiper unit 4 can prevent the ink received by the ink receiving surface 24 from scattering around the ink receiving surface 24.

Further, the wiper unit 4 includes the convex portion 23 and the wiper 3 or the first wiper 3A and the second wiper 3B (examples of a first protrusion and a second protrusion) that are disposed across the ink receiving surface 24 in the moving direction of the wiper unit 4 (in the horizontal direction). The first protrusion and the second protrusion extend in the direction perpendicular to the moving direction of the wiper unit 4. Thus, the wiper unit 4 can reliably prevent the ink received by the ink receiving surface 24 from scattering around the ink receiving surface 24.

When the wiper unit 4 moves in a state in which the ink receiving surface 24 faces at least one of the nozzles 302, the wiper 3 contacts at least another of the nozzles 302 and the nozzle plate face 302*a* (an example of a liquid discharge surface) including the nozzles 302. Thus, the wiper 3 contacts the nozzle 302 and the nozzle plate face 302*a* when the wiper unit 4 moves, and the wiper 3 thus can wipe and clean the nozzle 302 and the nozzle plate face 302*a*.

The liquid discharge apparatus 1000 includes the controller 500 that causes the head 300 to discharge ink from the nozzle 302 toward the ink receiving surface 24 after the wiper 3 passes through the nozzle 302 during the movement of the wiper unit 4. Thus, the liquid discharge apparatus 1000 can remove foreign matter and the like from the nozzle 302 and reliably discharge ink from the nozzle 302 toward the ink receiving surface 24.

The cleaning liquid collector 6 holds the cleaning liquid supplied to the ink receiving surface 24. Thus, the wiper unit 4 can clean the ink receiving surface 24 and also prevent the cleaning liquid received by the ink receiving surface 24 from being overflown from the cleaning liquid collector 6 when the ink receiving surface 24 moves to the position where the ink receiving surface 24 does not face the nozzle 302.

The wiper unit 4 includes the cleaning liquid supplier 5 that supplies the cleaning liquid to the ink receiving surface 24. Thus, the wiper unit 4 can reliably supply the cleaning liquid to the ink receiving surface 24 to reliably clean the ink receiving surface 24.

The carriage 1 includes the head 300 including the nozzle plate face 302*a* having nozzle 302. The head 300 includes the housing 304 that accommodates the liquid chamber 309, the valve 307, and the piezoelectric element 305. The valve 307 is an example of an opening and closing member that opens and closes a flow path between the liquid chamber 309 and the nozzle 302. The piezoelectric element 305 drives the valve 307.

Further, the liquid discharge apparatus 1000 according to the above embodiments of the present disclosure includes the carriage 1, and further includes the X-axis rail 101, the Y-axis rail 102, and the Z-axis rail 103, or the rail 830 (example of a guide), which movably hold the carriage 1 as described above.

Thus, the carriage 1 can discharge ink toward the object 100 (or the target object 702) while moving in the X-axis, Y-axis, and Z-axis directions. Irrespective of the position of the carriage 1 with respect to the object 100, the carriage 1 moves the ink receiving surface 24 to the facing position where the ink receiving surface 24 faces the nozzle 302 when necessary to enable the head 300 to discharge dried ink to the ink receiving surface 24 from the nozzle 302 without moving the nozzle 302 of the head 300 to the ink receiving surface 24. Thus, the ink receiving surface 24 can receive the dried ink purged from the nozzle 302.

Thus, the liquid discharge apparatus 1000 can continuously draw high quality images with smaller downtime since the liquid discharge apparatus 1000 can reduce a time required for the carriage 1 to move to the ink receiving surface 24 as compared with the configuration in which the carriage 1 moves toward the ink receiving surface 24 whose position is fixed.

As described above, according to the present disclosure, a liquid discharge device and a liquid discharge apparatus can be provided that discharge a liquid from a discharge port to a liquid receiving surface without moving the discharge port with respect to the liquid receiving surface and prevent the liquid received by the liquid receiving surface from being overflown.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

What is claimed is:

1. A liquid discharge device comprising:

a head including a nozzle plate face having a discharge port to discharge a liquid from the discharge port toward an object; and a mover including:

a liquid receiving surface to receive the liquid discharged from the discharge port; and a liquid collector to collect the liquid received by the liquid receiving surface, the liquid collector being disposed below the liquid receiving surface in a plane parallel to the nozzle plate face, wherein the mover holds the liquid receiving surface and the liquid collector, the mover being movable at a facing position where the liquid receiving surface faces the discharge port without changing an inclination of the liquid collector with respect to a horizontal plane.

2. The liquid discharge device according to claim 1, wherein the mover is movable at the facing position without changing a height of the liquid collector.

3. The liquid discharge device according to claim 1, wherein the mover is movable between the facing position and a position where the liquid receiving surface does not face the discharge port without changing the inclination of the liquid collector with respect to the horizontal plane.

4. The liquid discharge device according to claim 1, further comprising a chassis to hold the discharge port of the head and movably support the mover.

5. The liquid discharge device according to claim 1, wherein the head discharges the liquid from the discharge port in a direction intersecting a direction of gravity.

6. The liquid discharge device according to claim 1, wherein the mover includes a protrusion that protrudes toward the discharge port from the liquid receiving surface and extends in a direction parallel to the liquid receiving surface in a state in which the liquid receiving surface faces the discharge port.

7. The liquid discharge device according to claim 6, wherein the protrusion includes a first protrusion and a second protrusion disposed across the liquid receiving surface in a moving direction of the mover, and wherein the first protrusion and the second protrusion extend in a direction perpendicular to the moving direction of the mover.

8. The liquid discharge device according to claim 6, wherein the discharge port includes a plurality of discharge ports; and wherein, when the mover moves in a state in which the liquid receiving surface faces at least one of the discharge ports, the protrusion contacts at least another of the discharge ports.

9. The liquid discharge device according to claim 8, wherein, when the mover moves, the head discharges the liquid from the discharge port toward the liquid receiving surface after the protrusion passes through the discharge port.

10. The liquid discharge device according to claim 1, wherein the liquid collector collects a cleaning liquid supplied to the liquid receiving surface.

11. The liquid discharge device according to claim 10, further comprising a cleaning liquid supplier to supply the cleaning liquid to the liquid receiving surface.

12. The liquid discharge device according to claim 1, wherein the head includes:

a liquid chamber;

an opening and closing structure to open and close a flow path between the liquid chamber and the discharge port;

a piezoelectric structure to drive the opening and closing structure; and a housing accommodating the liquid chamber, the opening and closing structure, and the piezoelectric structure.

13. A liquid discharge apparatus comprising:

the liquid discharge device according to claim 1; and a guide to movably holds the liquid discharge device.

14. A liquid discharge device comprising:

a head including a nozzle plate face having a discharge port to discharge a liquid from the discharge port toward an object; and a mover including:

a liquid receiving surface to receive the liquid discharged from the discharge port; and a liquid collector to collect the liquid received by the liquid receiving surface, the liquid collector being disposed below the liquid receiving surface in a plane parallel to the nozzle plate face, wherein the mover holds the liquid receiving surface and the liquid collector, the mover being movable in a horizontal direction at a facing position where the liquid receiving surface faces the discharge port.

15. The liquid discharge device according to claim 14, wherein the mover is movable in the horizontal direction between the facing position and a position where the liquid receiving surface does not face the discharge port.

* * * * *